US009760059B2

(12) United States Patent
Katayama

(10) Patent No.: US 9,760,059 B2
(45) Date of Patent: Sep. 12, 2017

(54) PHOTOSENSITIVE MEMBER UNIT AND IMAGE FORMING APPARATUS INCLUDING THE SAME

(71) Applicant: CANON KABUSHIKI KAISHA, Tokyo (JP)

(72) Inventor: Hiromasa Katayama, Toride (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 15/001,571

(22) Filed: Jan. 20, 2016

(65) Prior Publication Data

US 2016/0216688 A1 Jul. 28, 2016

(30) Foreign Application Priority Data

Jan. 22, 2015 (JP) ..... 2015-010359
Jan. 22, 2015 (JP) ..... 2015-010360

(51) Int. Cl.
*G03G 21/18* (2006.01)
*G03G 15/02* (2006.01)

(52) U.S. Cl.
CPC ..... *G03G 21/1814* (2013.01); *G03G 21/1821* (2013.01); *G03G 15/0216* (2013.01); *G03G 21/181* (2013.01)

(58) Field of Classification Search
CPC ..... G03G 21/1814; G03G 21/181; G03G 21/1821; G03G 15/0216
See application file for complete search history.

(56) References Cited

U.S. PATENT DOCUMENTS 5,666,608 A * 9/1997 Christensen ..... G03G 15/025 399/115
8,210,530 B1 * 7/2012 Gayne ..... G03G 15/0189 271/273
2007/0140709 A1 * 6/2007 Yoshida ..... G03G 15/55 399/12

(Continued)

FOREIGN PATENT DOCUMENTS

JP 11-015239 A 1/1999
JP 11-095532 * 4/1999

(Continued)

*Primary Examiner* — Sandra Brase
(74) *Attorney, Agent, or Firm* — Fitzpatrick, Cella, Harper & Scinto

(57) ABSTRACT

A photosensitive member unit for an image forming apparatus includes a rotatable photosensitive drum; a charging roller including an elastic layer; a first spring urging the roller toward the drum; a drive receiving portion provided on the drum; a rotatable spacer including a contact portion contacted to the drive receiving portion and capable of receiving the driving force through the drive receiving portion, the spacer being rotatable between a spacing position for maintaining a spaced state in which the contact portion contacts the drive receiving portion to space the roller from the drum, and a contact position in which the spaced state between the drum and the roller is disestablished, and the spacer being movable toward the drum; a supporting member urging the spacer in a state that spacer is in the spacing position; and a second spring urging the supporting member toward a rotation axis of the spacer.

34 Claims, 15 Drawing Sheets

(56) References Cited

U.S. PATENT DOCUMENTS

| | | | | |
|---|---|---|---|---|
| 2007/0248382 | A1* | 10/2007 | Oguma | G03G 15/0216 399/167 |
| 2013/0121725 | A1 | 5/2013 | Shirayanagi | |
| 2014/0086630 | A1* | 3/2014 | Kitajima | G03G 21/1839 399/111 |
| 2016/0209803 | A1 | 7/2016 | Katayama | |

FOREIGN PATENT DOCUMENTS

| | | | |
|---|---|---|---|
| JP | 11-095532 | A | 4/1999 |
| JP | 2001-013762 | A | 1/2001 |
| JP | 2001-117466 | A | 4/2001 |
| JP | 2002-311690 | A | 10/2002 |
| JP | 2008-058686 | A | 3/2008 |
| JP | 2012-018265 | A | 1/2012 |
| JP | 2013-148629 | A | 8/2013 |

* cited by examiner

PHOTOSENSITIVE MEMBER UNIT AND IMAGE FORMING APPARATUS INCLUDING THE SAME

FIELD OF THE INVENTION AND RELATED ART

The present invention relates to a photosensitive member unit mountable to an image forming apparatus using an electrophotographic process and an image forming apparatus comprising the same.

For the purpose of making maintenance operation easy, an image forming apparatus of an electrophotographic type with which the photosensitive member unit including a photosensitive member and parts for the image formation as a unit is exchangeable is known. In the image forming apparatus of such a type, a contact charging type charging roller (charging member) having an elastic layer for charging the photosensitive member in contact with the photosensitive member using an urging force provided by a spring or the like is widely used.

In such a contact charging type, if the photosensitive member unit is left unoperated for a long term with the charging roller being in contact with the photosensitive member, the portion of the charging roller contacted with the photosensitive member is deformed with the result of image defect when the photosensitive member unit is operated after the long-term unoperated state.

In order to reduce production of such an image defect, the photosensitive member unit is shaped with a spacer placed between the photosensitive member and the charging roller, and the photosensitive member unit is mounted to the main assembly of the image forming apparatus after the spacer is removed.

With such a structure, however, a burden of removing the spaces is placed on the user when the photosensitive member unit is mounted to the main assembly of the image forming apparatus.

Under the circumstances, Japanese Laid-open Patent Application Hei 11-95532 discloses a structure in which when the photosensitive member unit is mounted to the main assembly of the image forming apparatus, the charging roller having been in the spaced position is brought into contact to the photosensitive member by the rotation of the photosensitive member, without the necessity of removing the spacer by the user. More specifically, the charging roller is spaced from the photosensitive member in the state that an engaging portion in the form of a sector provided on a free end of a spacer member engaged with a rotation shaft of the charging roller is engagement with a photosensitive member gear provided the coaxial with the photosensitive member. With such a structure, by rotating the photosensitive member, the spacer member rotates so that the spacer member is disengaged from the photosensitive member gear, thus bring the charging roller into contact to the photosensitive member.

However, with the structure disclosed in Japanese Laid-open Patent Application Hei 11-95532, there is a likelihood that the photosensitive member rotates by a vibration imparted to the photosensitive member unit in the period from the shipment of the photosensitive member unit to the mounting thereof to the main assembly of the image forming apparatus, that is, during transportation, for example. If this occurs, the rotation of the photosensitive member disengages the spacer member, with the result that the charging roller is contacted to the photosensitive member unintentionally.

Japanese Laid-open Patent Application 2012-18265 discloses a structure in which the spacer member is rotatably engaged with the rotational shaft of the charging roller urged toward the photosensitive member, and a shape of the spacer member which is contacted to the photosensitive member when the charging roller is spaced from the photosensitive member, is a recessed shape. By employing such a structure, in order to rotate the spacer member to release the spacing locking, a force is required to ride over the recessed shape against the urging force to the charging roller. In this manner, even when the photosensitive member rotate unintentionally by the vibration imparted to the photosensitive member unit, the occurrence of the unintentional release of the spacing locking.

However, even with such a structure, before the photosensitive member unit is mounted to the main assembly of the image forming apparatus, there is still a likelihood that a strong vibration imparted to the photosensitive member unit with the result that the spacer member is moved together with the charging roller away from the photosensitive member. In such a case, with the structure of Japanese Laid-open Patent Application 2012-18265, when the spacer member move in the direction away from the photosensitive member together with the charging roller, the spacer member freed from the photosensitive member and the gear may rotate with the result of release of the spaced state locking.

SUMMARY OF THE INVENTION

Accordingly, it is an object of the present invention to provide a photosensitive member unit and an image forming apparatus comprising the same in which the unintentional destruction of the spaced state between the photosensitive member and the charging member can be suppressed.

According to an aspect of the present invention, there is provided a photosensitive member unit detachably mountable to a main assembly of a image forming apparatus, said photosensitive member unit comprising a rotatable photosensitive member; a charging member including an elastic layer and contactable to said photosensitive member to electrically charge said photosensitive member; first urging means configured to urge said charging member toward said photosensitive member; a drive receiving portion provided on said photosensitive member to receive a driving force for rotating said photosensitive member from the main assembly; a rotatable spacer member including a contact portion contacted to said drive receiving portion and capable of receiving the driving force through said drive receiving portion, said spacer member being rotatable between a spacing position for maintaining a spaced state in which said contact portion contacts said drive receiving portion to space said charging member from said photosensitive member, and a contact position in which the spaced state between said photosensitive member and said charging member is disestablished to permit contact between said photosensitive member and said charging roller, and said spacer member being movable toward said photosensitive member with movement of said charging roller toward said photosensitive member by said first urging means when the spaced state is disestablished; a supporting member configured to urge and support said spacer member in a state that spacer member is in the spacing position; and second urging means configured to urge said supporting member toward a rotation axis of said spacer member.

Further features of the present invention will become apparent from the following description of exemplary embodiments with reference to the attached drawings.

DESCRIPTION OF THE EMBODIMENTS

Figure 1:
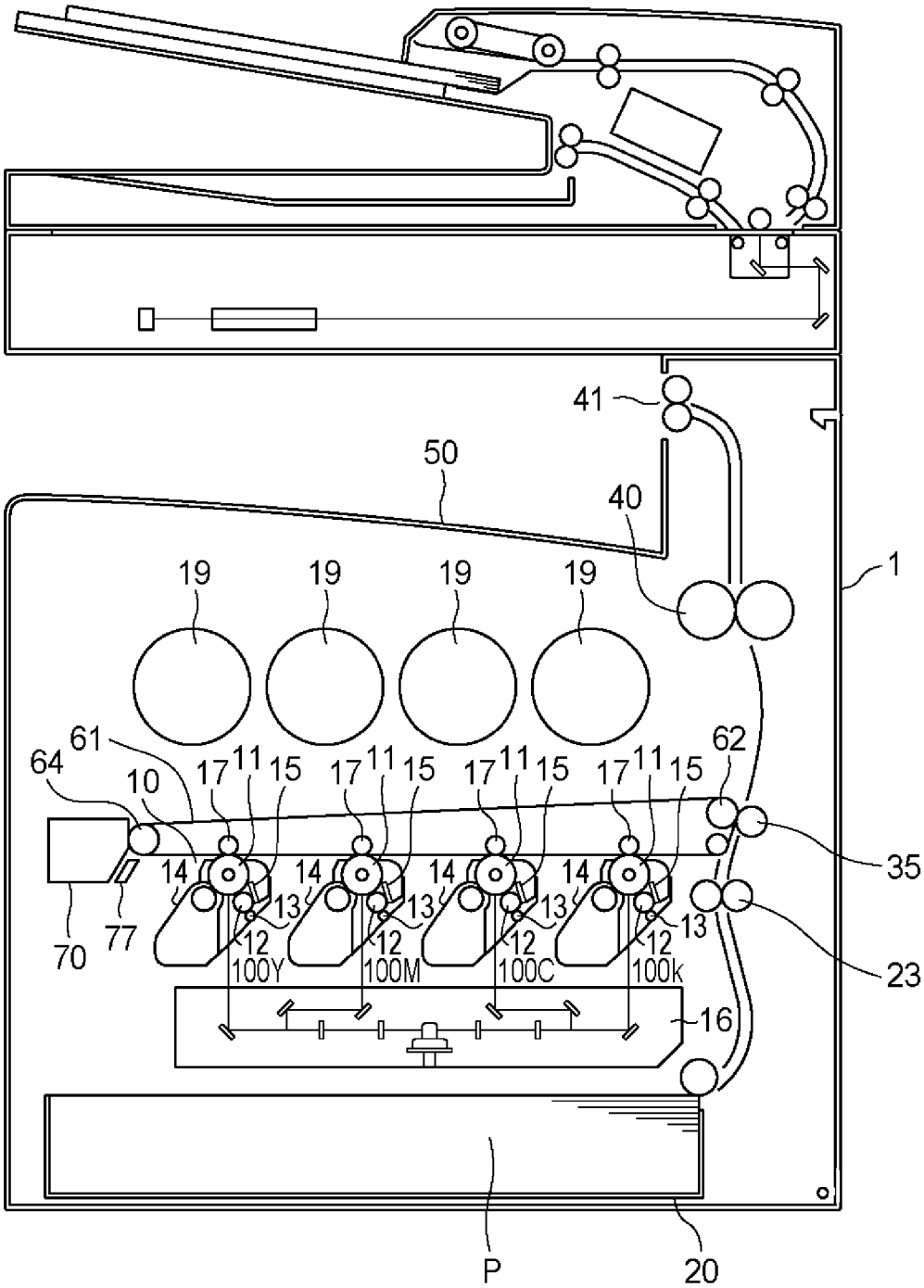
FIG. 1 is a schematic sectional view of an image forming apparatus.

The preferred embodiments of the present invention will be described in conjunction with the accompanying drawings. Here, the dimensions, the sizes, the materials, the configurations, the relative positional relationships of the elements in the following embodiments and examples are not restrictive to the present invention unless otherwise stated. In the description of the embodiments, the same reference numerals are assigned to the elements having the corresponding functions, and the detailed description thereof is omitted for simplicity.

(Embodiment 1)

Referring first to FIG. 1, a general arrangement and operation of an image forming apparatus will be described. Then, the description will be made as to a space keeping mechanism for keeping the spacing between the photosensitive member and a charging roller as a charging member, and an automatic releasing mechanism for the space keeping mechanism operable with the driving of the photosensitive member supplied with a driving force from the main assembly of the image forming apparatus.

(General Arrangement and Operation of Image Forming Apparatus)

FIG. 1 is a schematic sectional view of the image forming apparatus according to an embodiment of the present invention. The image forming apparatus 1 of this embodiment is an intermediary transfer type and tandem type image forming apparatus which is capable of forming a full-color image using an electrophotographic type.

The image forming apparatus 1 of this embodiment comprises image forming stations for forming toner images of Y (yellow), M (magenta), C (cyan) and K (black) colors, respectively. The structures and operations of the image forming stations are substantially the same except that the colors of the toners contained therein are different from each other. Therefore, the following description will be made without the suffixes Y, M, C and K, which means the description applies to all of the image forming stations, unless otherwise stated particularly.

The image forming station includes a photosensitive drum 11 (photosensitive member) as the image bearing member which is a drum shape (cylindrical) electrophotographic photosensitive member (photosensitive member). The photosensitive drum 11 is supplied with a driving force from an unshown driving means provided in the main assembly of the image forming apparatus to rotate at a process speed (peripheral speed) of 100 mm/sec. In the image forming station, the following means are provided around the photosensitive drum in the order named along the rotational moving direction. A charging roller 12 which is a charging member in the form of a rotatable roller as charging means is provided. Then, there is an image exposure position where a surface of the photosensitive drum 11 is exposed to image light by an exposure device (laser scanner device) 16 as exposure means (electrostatic latent image forming means). Then, a developing device 14 as developing means is provided. The developing device 14 is supplied with toner through an unshown toner feeding path from a toner bottle 19 as a toner container. Then, a primary transfer roller 17 which is a primary transfer member in the form of a roller is provided as primary transferring means. Then, a drum cleaning device 15 as cleaning means for the photosensitive member is provided. In addition, in the image forming station, there is provided a cleaning roller 13 which is a charging cleaning member in the form of a roller as cleaning means for the charging member, and the cleaning roller 13 is contacted to the charging roller 12. In this embodiment, the charging roller 12 is contacted to the surface of the photosensitive drum 11 with a predetermined urging force by urging means such as a spring, and is rotated by the rotation of the photosensitive drum 11.

In addition, in this embodiment, the cleaning roller 13 is contacted to the surface of the charging roller 12 with a predetermined urging force by urging means such as a spring, and is rotated by the rotation of the charging roller 12.

The image forming apparatus 1 comprises an intermediary transfer belt 61 of an endless belt member as an intermediary transfer member, and the intermediary transfer belt 61 is contactable to each of the photosensitive drums 11 of the image forming stations. The intermediary transfer belt 61 is extended around a plurality of supporting rollers (stretching rollers) with a predetermined tension. The primary transfer rollers 17 are provided on an inner surface side (back side) of the intermediary transfer belt 61 at the positions opposed to the respective photosensitive drums 11. The primary transfer roller 17 is pressed toward the photosensitive drum 1 through the intermediary transfer belt 61 to form a primary transfer portion (primary transfer nip) N1 where the intermediary transfer belt 61 and the photosensitive drum 11 are contacted to each other. The primary transfer roller 17 is rotated by the rotation of the intermediary transfer belt 61. In an outer peripheral surface side (front side) of the intermediary transfer belt 61, a secondary transfer roller 35 which is a secondary transfer member in the form of a roller as secondary transferring means is provided at a position opposed to a secondary transfer opposing roller 62. The secondary transfer roller 35 is pressed toward the secondary transfer opposing roller 35 through the intermediary transfer belt 61 to form a secondary transfer portion (secondary transfer nip) N2 where the intermediary transfer belt 61 and the secondary transfer roller 35 are contacted to each other. In the outer peripheral surface side of the intermediary transfer belt 61, there is provided a belt cleaning device 70 as intermediary transfer member cleaning means, at the position opposed to the tension roller 64. The intermediary transfer belt 61 is an endless belt of dielectric resin material such as polyimide.

Furthermore, the image forming apparatus 1 comprises a feeding roller 23 for feeding a recording material P such as a sheet, and a fixing device 40 for fixing the toner image on the recording material P.

During the image forming operation, the surface of the rotating photosensitive drum 11 is electrically charged uniformly to a predetermined potential of a predetermined polarity by the charging roller 12. In this embodiment, the charging roller 12 is supplied with only a DC voltage of −1300V from an unshown high voltage source (charging voltage source) so that electric discharge occurs to the surface of the photosensitive drum, thus charging the surface of the photosensitive drum to approx. −700V.

After the uniform charging of the photosensitive drum, the surface of the photosensitive drum is scanned and the exposed to the image light in accordance with the image information signal by a laser scanner 16, so that an electrostatic latent image (electrostatic image) is formed on the photosensitive drum. The latent image formed on the photosensitive drum 11 is developed into a toner image with the toner as a developer by the developing device 14. In this embodiment, the regular charge polarity of the toner is negative. The developing device 14 includes a developing sleeve as a developer carrying member for carrying and feeding the toner to an opposing portion (developing position) relative to the photosensitive drum 11. The developing sleeve is rotated. During the developing operation, the developing sleeve is supplied with a predetermined developing voltage (developing bias voltage) from the high voltage source as an unshown developing voltage source. The developing voltage is an oscillating voltage in the form of an AC voltage (AC component) biased with a DC voltage (DC component).

The toner image formed on the photosensitive drum 11 is transferred onto a surface of the intermediary transfer belt 61 (primary-transfer) in the primary transfer portion N1 by the function of the primary transfer roller 17. At this time, the primary transfer roller 17 is supplied with the primary transfer voltage (primary transfer bias) which is a DC voltage having a polarity (positive in this embodiment) opposed to the charge polarity of the toner at the time of the development. In the formation of a full-color image, the above-described operations are carried out in the respective image forming stations, by which the toner images of the yellow, magenta, cyan and black toner images are sequentially transferred onto the intermediary transfer belt 61 in a superimposed relationship.

A slight amount of untransferred toner remaining on the photosensitive drum 11 at the image transfer operation, is removed by the cleaning blade 15 as the cleaning member and is collected into a collection portion.

On the other hand, a recording material P is singled out of a sheet feeding cassette 20 and is fed to the pair 23 of the registration rollers. Thereafter, the pair 23 of the registration rollers feeds the recording material P into between the intermediary transfer belt 61 and the outer secondary-transfer roller in synchronism with the toner image on the intermediary transfer belt 61. The color toner images on the intermediary transfer belt 61 are transferred (secondary-transfer) onto the surface of the recording material P by the function of the secondary transfer roller 35 in the secondary transfer portion N2. When the recording material P passes through the secondary transfer portion N2, the secondary transfer roller 35 is supplied with the secondary transfer voltage (secondary transfer bias voltage) which is a DC voltage having a polarity opposed to the toner charge polarity at the time of the development, from unshown secondary transfer voltage source (high voltage source). A slight amount of remaining toner remaining on the intermediary transfer belt 61 after the image transfer operation is removed and collected by the cleaning unit 70 to prepare for the next image forming operation. The toner image transferred onto the recording material P is heated and pressed by the fixing device 40 to be fixed on the recording material, and the sheet is discharged onto a sheet discharge tray 50 by a pair 41 of sheet discharging rollers.

(Charging Roller)

The charging roller 12 of this embodiment will be described.

In this embodiment the charging roller 12 as the charging member is a roller member comprising an electroconductive supporting member (core metal, core material) 12*a* as a rotation shaft, and an elastic layer 12*b* having one or more layers formed on the electroconductive supporting member 12*a*. The outer peripheral surface thereof contacts to the photosensitive drum 11 as the photosensitive member. Particularly in this embodiment, the elastic layer 12*b* of the charging roller 12 has a two-layer-structure including a base layer and a surface layer, and the materials of the base layer and the surface layer of the elastic layer 12*b* are different. More particularly, at least the base layer and the surface layer are provided on the electroconductive supporting member 12*a*, in which the surface layer (upper layer) is provided with a proper volume resistivity, and on the other hand, the base layer (lower layer) is provided with a elasticity which is suitable to provide a proper contact relative to the photosensitive member. By doing so, the uniform charging of the photosensitive member is accomplished, and an electric leakage due to the damage or pin hole of the surface of the photosensitive member can be prevented.

The materials usable for the surface layer of the charging roller 12 include acrylic resin material, polyamide resin material, polyurethane resin material the fluorinated resin material, a mixture thereof, and one of these materials dispersed with electroconductive particles such as carbon black, metal oxide or the like. In this embodiment, the surface layer of the charging roller 12 comprises acrylic resin material as a main component. These materials are capable of providing the charging roller 2 with a high negative charging property by an electronic suction effect. The surface layer of the charging roller 12 can be formed by dip coating, spray coating, roller coating, for example.

The materials usable for the base layer of the charging roller 12 include a synthetic rubber such as ethylene propylene rubber (EPDM), styrene butadiene rubber (SBR), chloroprene rubber (CR), nytril butadiene rubber (NBR), butyl rubber (BR), isoprene rubber (IR), epichlorohydrin rubber (CO, ECO), urethane rubber (U) or silicone rubber, natural rubber (NR), styrene butadiene styrene (SRS), polyolefin or polyurethane thermoplastic elastomer, or a mixture thereof. In this embodiment, the base layer of the charging roller 12 is mainly made of an intermediate resistance material having an ion electroconductive mechanism using epichlorohydrin rubber (ECO, CO). In order to stably contact the photosensitive member and charging roller 12 with each other, the material of the base layer is preferably synthetic rubber material. As for the charging roller 12, it may be elastic material dispersed with electroconductive powder of carbon black, graphite, metal powder, metal oxide or the like to provide the electroconductivity. In other to decrease the resistance to the satisfactory extent, a relatively large amount of electroconductive fine particles may be added in the elastic material. In the case that a large amount of the electroconductive fine particles is added, the hardness of the elastic material may increase, and in such a case, in order to decrease the hardness, a relatively large amount of softening oil and/or plasticizer may be added. The base layer of the charging roller 12 may be formed by metal mold molding or the like.

(Cleaning Roller)

The cleaning roller 13 in this embodiment will be described.

In this embodiment, the cleaning roller 13 as the charging cleaning member comprises a rod-like supporting portion (core metal the core material) 13*a* as a rotation shaft, and an elastic layer 13*b* formed on the outer periphery of the supporting portion 13*a*, and the outer peripheral surface of the cleaning roller 13 contacts the charging roller 12. The elastic layer 13*b* comprises an elastic foam layer as a most outer layer (contact portion) contacting to the surface (outer peripheral surface) of the charging roller 12. Particularly, in this embodiment, the cleaning roller 13 comprises the supporting portion 13*a*, the elastic foam layer 13*b* contactable to the charging roller 12 formed on the outer peripheral surface of the supporting portion 13*a*. If the elastic layer 13*b* has an elastic foam layer as the most outer layer, a single or plurality of inside layers may be provided on the inside thereof. The structure of the elastic foam (porous elastic member) of the elastic foam layer 13*b* may have continuous pores.

The supporting portion 13*a* of the cleaning roller 13 is preferably a columnar rod-like member. The material of the supporting portion 13*a* is not particularly limited, and may be metal, synthetic resin material or the like. When the supporting portion 13*a* is made of synthetic resin material, it is preferable that the electroconductive material is added to provide the electroconductivity. The supporting portion 13*a* may be a columnar shaft of metal or resin material, for example.

The elastic foam layer of the cleaning roller 13 has a substantially uniform thickness on the outer peripheral surface of the supporting portion 13*a* to provide an outer cylindrical shape. The bubble generation resin material of the elastic foam layer 13*b* of the cleaning roller 13 may be added with a charging control material (electroconductive material) having a lower triboelectric charge property relative to the material of the surface of the charging roller 12 than that of the bubble generation resin material. The thickness of the bubble generation elastic layer 13*b* of the cleaning roller 13 may be properly selected, but it is preferably 1-50 mm, further preferably 1-15 mm. The radius of the entirety of the cleaning roller 13 is preferably 2-100 mm, and further preferably 2-40 mm.

The bubble generation resin material is typically formed by sprucing and expanding a gas in the melted or fluid synthetic resin material, then solidifying the resin material into porous resin material. Preferable materials of the synthetic resin material include thermoplastic resin material such as polyethylene, polypropylene, polyvinyl chloride, polystyrene, polyvinyl alcohol, viscose, ionomer or the like, or thermosetting resin material such as polyurethane the epoxy resin material, phenol/urea resin material, melamine resin material, urea/formaldehyde resin material, pyranyl resin material, silicone resin material, acrylic resin material or the like. The foaming material may be a physical foaming material producing a gas by a physical change, but a chemical foaming material producing a gas by heating is preferable. The source material resin may be a thermosetting resin material from the standpoint of the hardness and the durability. As for such a thermosetting resin material, the urethane resin material and the melamine resin material are usable, and urethane resin material is preferable.

Examples of the electroconductive material include carbon black or metal particle as an electronic electroconductive material, or a monomer as an ion electroconductive material which can provide ion electroconductive. By kneading these materials in the bubble generation resin material, the charge of the cleaning roller 13 is neutralized to electrically discharge it. In this embodiment, the ion electroconductive material is preferable from the standpoint of reduction of scrape or the like of the surface of the charging roller 12 caused by the electroconductive material such as the carbon black or metal particle.

(Drum Cartridge)

Figure 2:
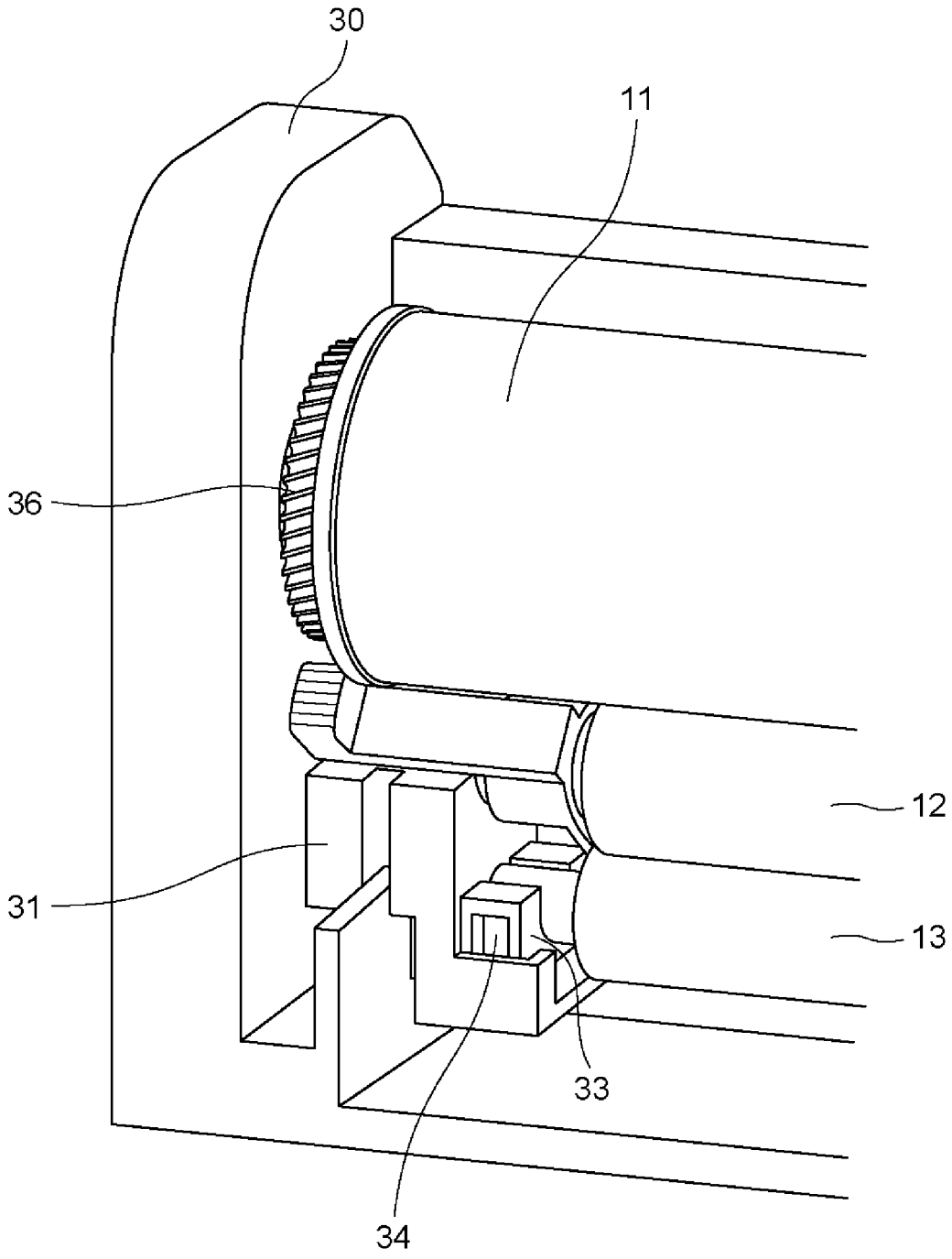
FIG. 2 is a perspective view of a photosensitive member unit.
Figure 3:
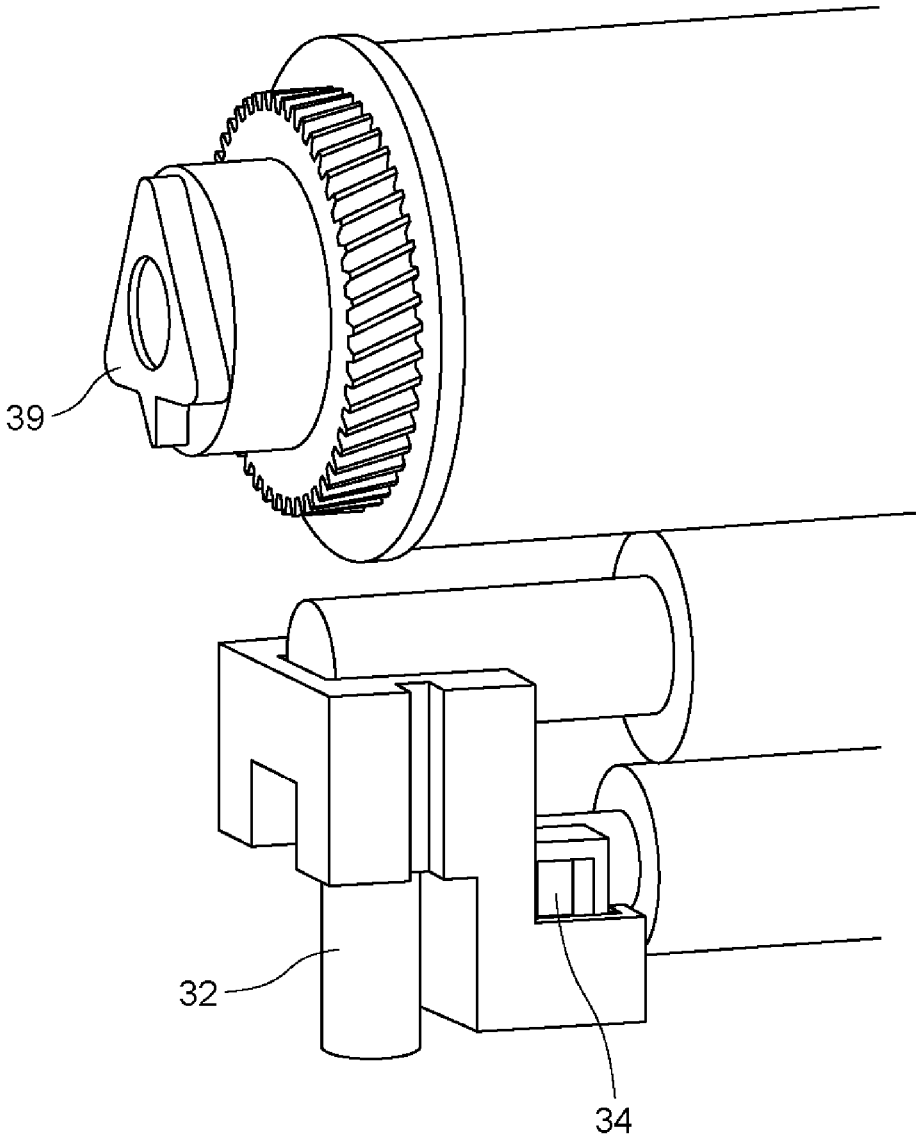
FIG. 3 is a perspective view of an urging mechanism for the charging roller in the photosensitive member unit.
Figure 4:
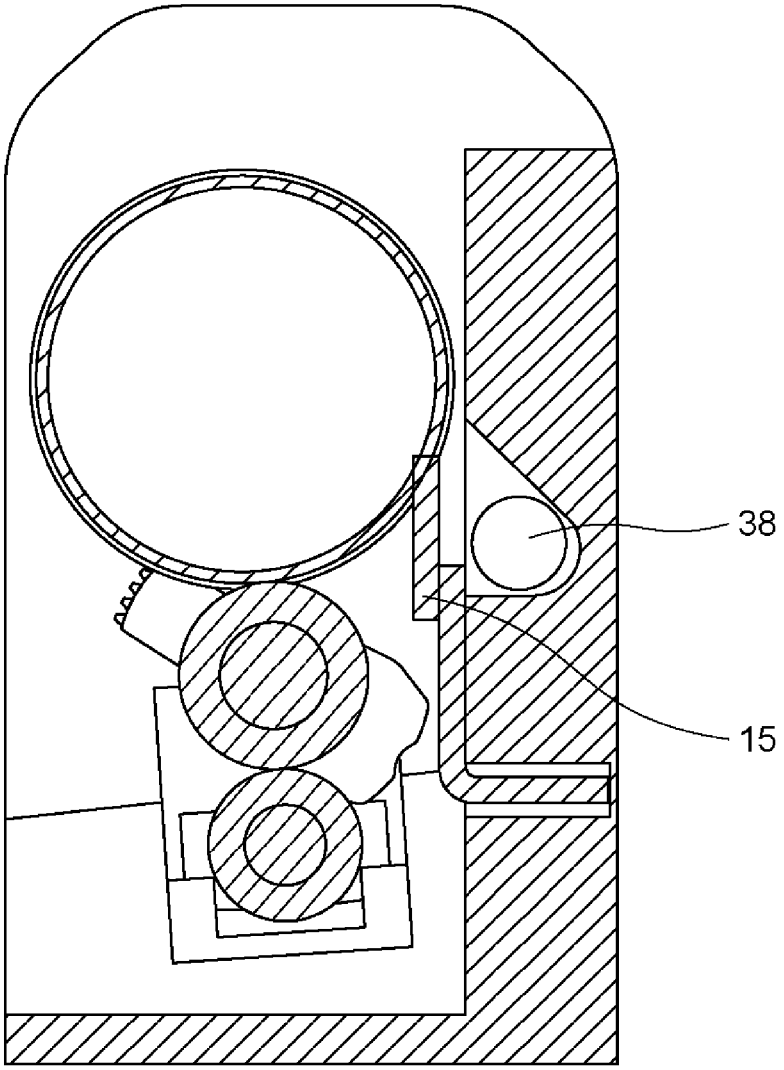
FIG. 4 is a sectional view of the photosensitive member unit.

Using FIGS. 2-4, the structure of the drum cartridge 100 as the photosensitive member unit will be described.

The drum cartridge 100 of this embodiment comprises the photosensitive drum 11 as the photosensitive member, the charging roller 12 as the charging member, the cleaning roller 13 as the charging cleaning member, and the cleaning blade 15 as the cleaning member, which are integrally contained in a drum container 30 as a frame. The drum cartridge 100 can be detachably mounted to the main assembly of the image forming apparatus by sliding in the longitudinal direction, and with such a structure, the drum cartridge 100 can be maintained by exchanging it.

In the drum container 30, the photosensitive drum 11 is supported by bearings (unshown) rotatably about a rotational axis, and the photosensitive drum 11 is provided with a coupling 39, and when the drum container 30 is mounted to the main assembly of the image forming apparatus, the photosensitive drum 11 is capable of receiving a driving force from the motor (unshown) as a driving source provided in the main assembly through the coupling 39.

The drum container 30 is provided with a cleaning blade 15 as the cleaning member for cleaning the surface of the photosensitive member, the cleaning blade 15 being fixed to the drum container 30 so as to contact to the surface of the photosensitive member counterdirectionarily with respect to the rotational direction of the photosensitive member during the image forming operation. In the neighborhood of food of the cleaning blade 15, there is provided a collection portion for collecting the untransferred toner removed from the surface of the photosensitive member by the cleaning blade 15, and also a toner feeding screw 38 is provided as a feeding portion for feeding the toner collected in the collection portion toward an outside of the drum cartridge 100 (photosensitive member unit). The toner fed by the toner feeding screw 38 to the outside of the drum cartridge 100 is collected into a residual toner container (unshown) provided in the main assembly of the image forming apparatus. A longitudinal end portion of the photosensitive drum 11 is provided with a gear 36 as a drive receiving portion (rotatable member) so as to be rotatable integrally with the photosensitive drum about the rotational axis of the photosensitive drum, and the rotational force of the gear 36 is transmitted to the toner feeding screw 38 so that the toner feeding screw 38 is rotated, by which the untransferred toner collected in the collection portion can be fed out of the drum cartridge 100.

The charging roller 12 are rotatably supported by a rotation shaft 12*a* being supported by charging roller bearings 31 as a holding portion. The charging roller bearings 31 are slidably supported relative to the drum container 30. More particularly, the charging roller bearings 31 are slidable in the direction of the axis of the photosensitive drum 11, so that the supported charging roller is movable toward the rotational axis of the photosensitive drum 11 in a plane perpendicular to the rotational axis of the photosensitive drum 11. Furthermore, between the drum container 30 and the charging roller bearing 31, there is provided a charging roller urging spring 32 as a first urging means, and the charging roller urging spring 32 urges the charging roller toward the rotational axis of the photosensitive drum 11 in the plane perpendicular to the rotational axis of the photosensitive drum (urging direction), and therefore, the charging roller 12 is press-contacted to the photosensitive drum 11.

The cleaning roller 13 as the charging cleaning member is rotatably supported by the rotation shaft 13*a* being supported by the cleaning roller bearings 33, and the cleaning roller bearing 33 is slidably supported relative to the charging roller bearing 31. More particularly, the cleaning roller bearing 33 is slidable toward the rotation axis of the space keeping member 200 (toward the rotational axis of the charging rollers) so that the cleaning roller 13 is movable toward the rotation axis of the space keeping member 200 (toward the rotational axis of the charging roller) in the plane perpendicular to the rotation axis of the space keeping member 200. Furthermore, between the charging roller bearing 31 and the cleaning roller bearing 33, there is provided a cleaning roller urging spring 34 as a cleaning roller 13, and the cleaning roller urging spring 34 urges the cleaning roller 13 toward the rotation axis of the space keeping member 200 in the plane perpendicular to the rotation axis of the space keeping member 200 (toward the rotational axis direction of the charging roller 12) (urging direction), and therefore, the cleaning roller 13 is press-contacted to the charging roller 12. That is, the cleaning roller 13 is movable in the urging direction of the cleaning roller urging spring 34 in the urging direction. In this embodiment, the urging direction of the first urging means is the same as the urging direction of the second urging means.

With the above-described structure, when the photosensitive drum 12 is rotated by the driving force supplied from the driving source provided in the main assembly of the image forming apparatus, the charging roller 12 is driven by the photosensitive drum 11 through the frictional force therebetween, and when the charging roller 12 rotates, the cleaning roller 13 is rotated by the frictional force relative to the charging roller 12. In addition, the toner feeding screw 38 receives the driving force (rotational force) from the gear 36 to rotate. With such a structure, the cleaning roller 13 moves in the moving direction of the charging roller 12 in interrelation with the movement of the charging roller 12 away from the photosensitive drum 11.

(Space Keeping Mechanism)

Figure 5:
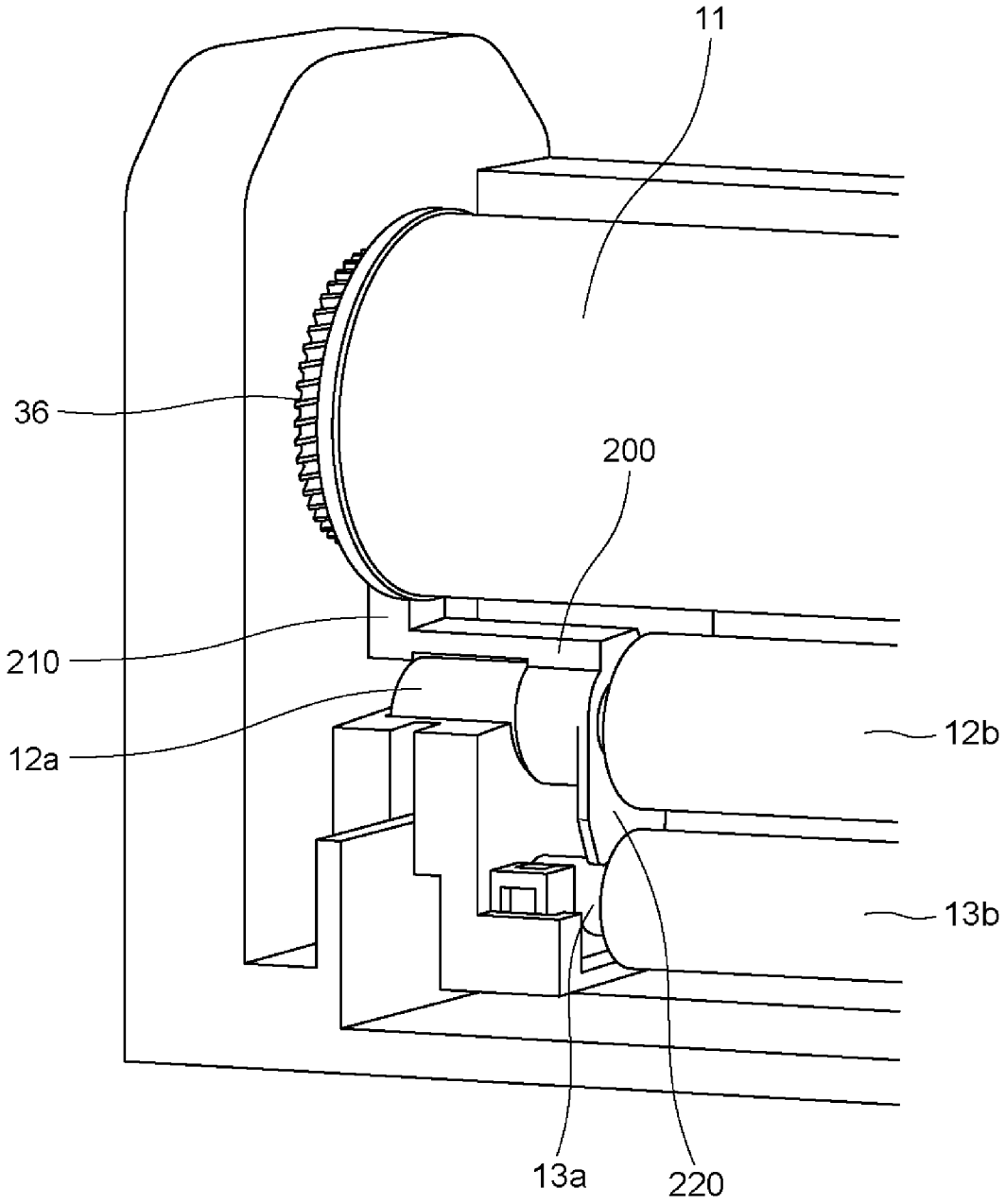
FIG. 5 is a perspective view illustrating a space keeping state of the photosensitive member unit.
Figure 6:
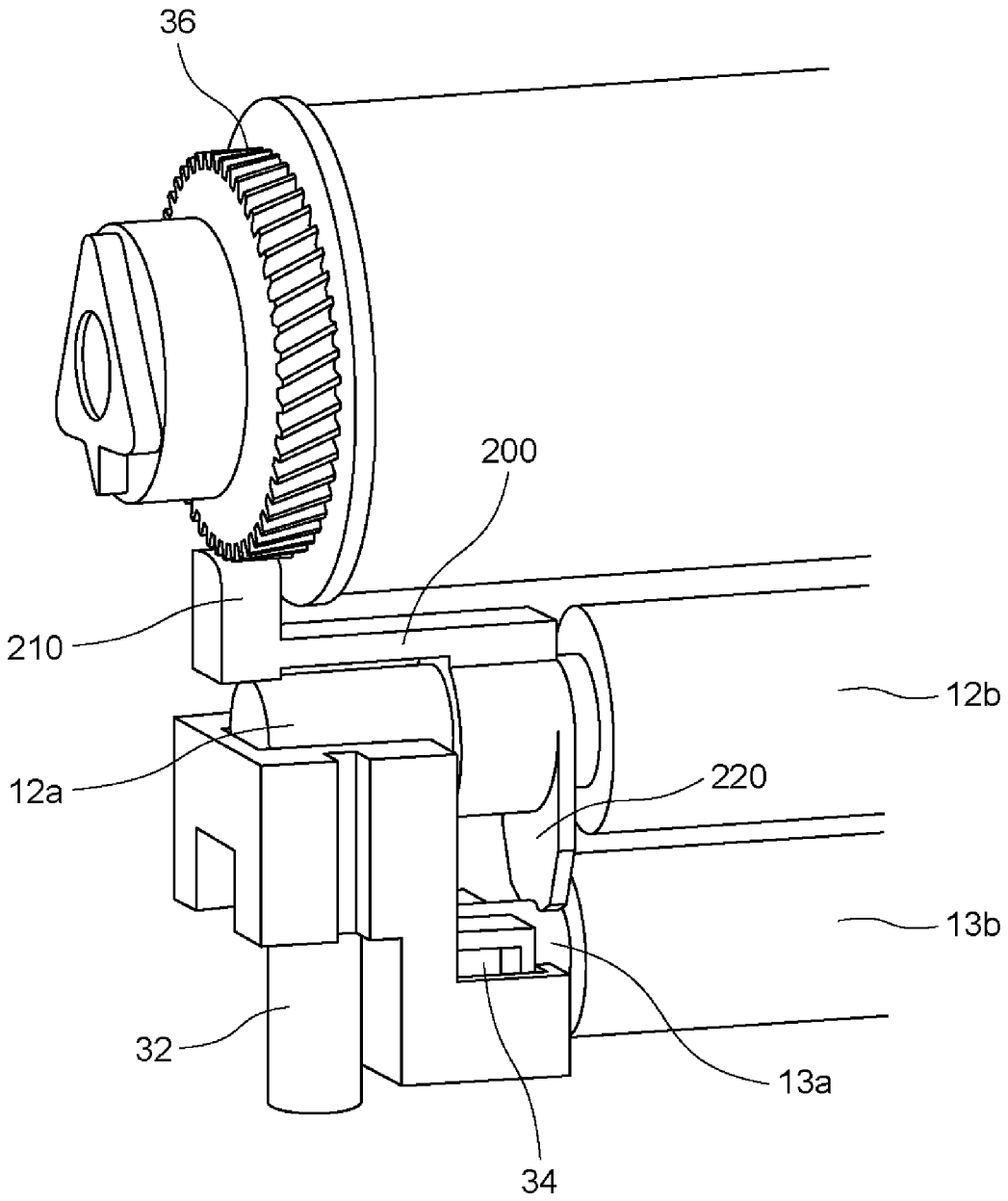
FIG. 6 is a perspective view illustrating a space keeping and urging mechanism of the photosensitive member unit.

Referring to a FIGS. 5 and 6, the description will be made as to the space keeping mechanism for maintaining the spaced state between the photosensitive drum 11 and the charging roller 12.

The drum cartridge 100 as the photosensitive member unit is provided with the 200 as the spacer member for assuring a gap between the charging roller 12 and the photosensitive drum 11 and a gap between the charging roller 12 and the cleaning roller 13 during the transportation of the drum cartridge 100.

The space keeping member 200 is provided rotatably about an axis of the rotation shaft 12*a* of the charging roller at each of the opposite end portions of the rotation shaft 12*a* of the charging roller 12. That is, the space keeping member 200 is supported by the charging roller 12 rotatably about the rotational axis of the charging roller 12. Therefore, the spaced keeping member 200 is movable in interrelation with the movement of the charging roller 12. The structure of the space keeping members 200 are substantially the same, and therefore, the description will be made only one of them.

The space keeping member 200 is provided with a space keeping portion 210 for spacing and keeping the space between the photosensitive drum 11 and the charging roller 12 and is provided with a space keeping portion 220 for spacing and keeping the space between the charging roller 12 and the cleaning roller 13.

In the space keeping state (spaced state) in which the photosensitive drum 11 and the charging roller 12 are spaced from each other, and the charging roller 12 and the cleaning roller 13 are spaced from each other, the space keeping portion 210 is sandwiched between the gear 36 and the rotation shaft 12*a* of the charging roller 12 (rotational shaft of the space keeping member 200) by the pressure (urging force) of the charging roller urging spring 32 as the first urging means. In addition, in the space keeping state, the space keeping portion 220 is pressed against the cleaning roller 13 as the supporting member by the pressure (urging force) of the cleaning roller urging spring 34 as the second urging means between the rotation shaft 12*a* of the charging roller 12 (rotational shaft of the space keeping member 200) and the rotation shaft 13*a* of the cleaning roller 13.

By this, the elastic layer of the charging roller 12 is spaced from the photosensitive drum 11, and in addition, the cleaning roller 13 is spaced from the charging roller 12.

Figure 7:
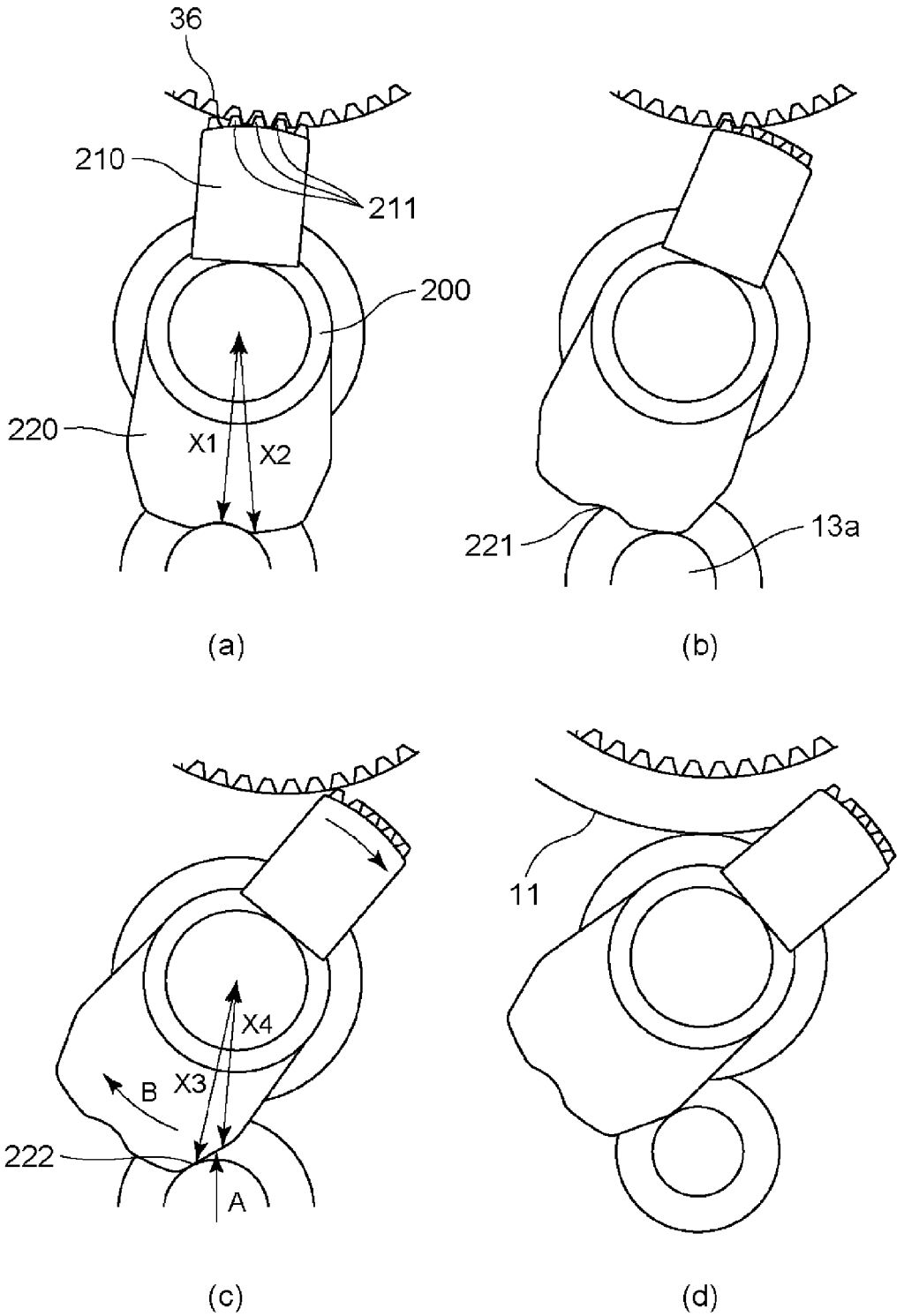
FIG. 7 is an illustration of an automatic disestablishing operation of the space keeping.

As shown in part (a) of FIG. 7, a side surface opposed to the gear 36 of the space keeping portion 210 in the space keeping state is provided with an engaging portion 211 as a contact portion having gear teeth (projections, engaging portions) having a pitch which is the same as the gear teeth surface pitch of the gear 36. In the space keeping state in which the charging roller 12 is spaced from the photosensitive drum 11, the gear 211*a* is engaged with the gear 36. In other words, at this time, the space keeping member 200 is in a spacing position for keeping the spaced state in which the photosensitive drum 11 and the charging roller 12 are spaced from each other by the engagement of the engaging portion 211 with the rotatable gear 36.

In addition, the side surface opposed to the cleaning roller 13 of the space keeping portion 220 in the space keeping state is provided with a receiving surface 221 (supported portion) of the cleaning roller as a first portion in the form of a recess. In the space keeping state, the rotation shaft 13*a* of the cleaning roller 13 as the supporting member is in the receiving surface 221. In the space keeping state, a pressure (urging force) is applied from the cleaning roller urging spring 34 as the second urging means to the cleaning roller 13 as the supporting member toward the rotation axis in the plane perpendicular to the rotation axis of the space keeping member 200. By the pressure, the cleaning roller presses the receiving surface 221, so that the space keeping portion 220 is sandwiched between the rotation shaft 12*a* of the charging roller 12 (the rotational shaft of the space keeping member 200) and the rotation shaft 13*a* of the cleaning roller 13, by which the spaced keeping member 200 is retained therebetween.

Until the automatic disestablishment of the space keeping state by the driving of the photosensitive drum 11 after the mounting of the drum cartridge to the main assembly image forming apparatus, after the shipment of the drum cartridge, the spaced states are maintained between the photosensitive drum 11 and the charging roller 12 and between the charging roller 12 and the cleaning roller 13.

Figure 8:
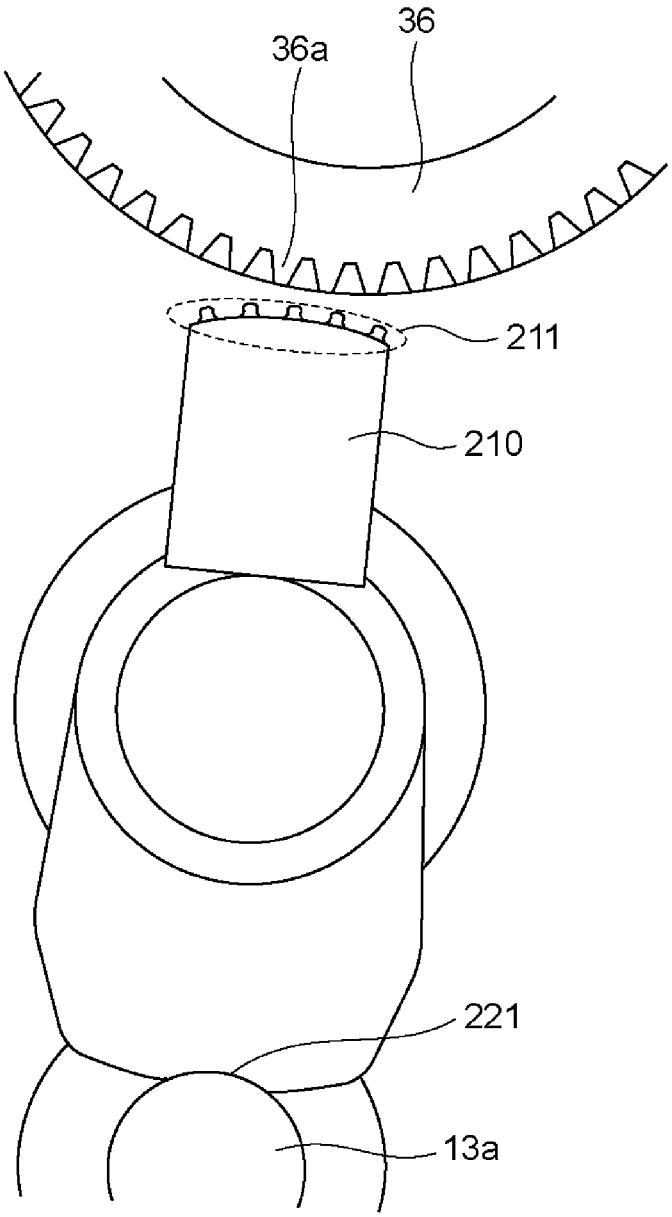
FIG. 8 is an illustration of a state in which the space keeping member is in a spacing position.

With such structures, even if the gear 36 and the engaging portion 211 are disengaged temporarily from each other as shown in FIG. 8 by the vibration and/or falling, for example, during the transportation of the drum cartridge the rotation of the space keeping member 200 can be suppressed because the spring force (urging force) of the cleaning roller urging spring 34 urges the rotation shaft 13*a* of the cleaning roller 13 to the receiving surface 221 of the space keeping member 200 toward the rotation axis of the space keeping member 200.

Here, referring to FIG. 9, the description will be made as to the states between the charging roller 12 and the charging roller urging spring 32 and between the cleaning roller 13 and the cleaning roller urging spring 34 when the space keeping member 200 and the charging roller 12 move away from the photosensitive drum 11.

Figure 9:
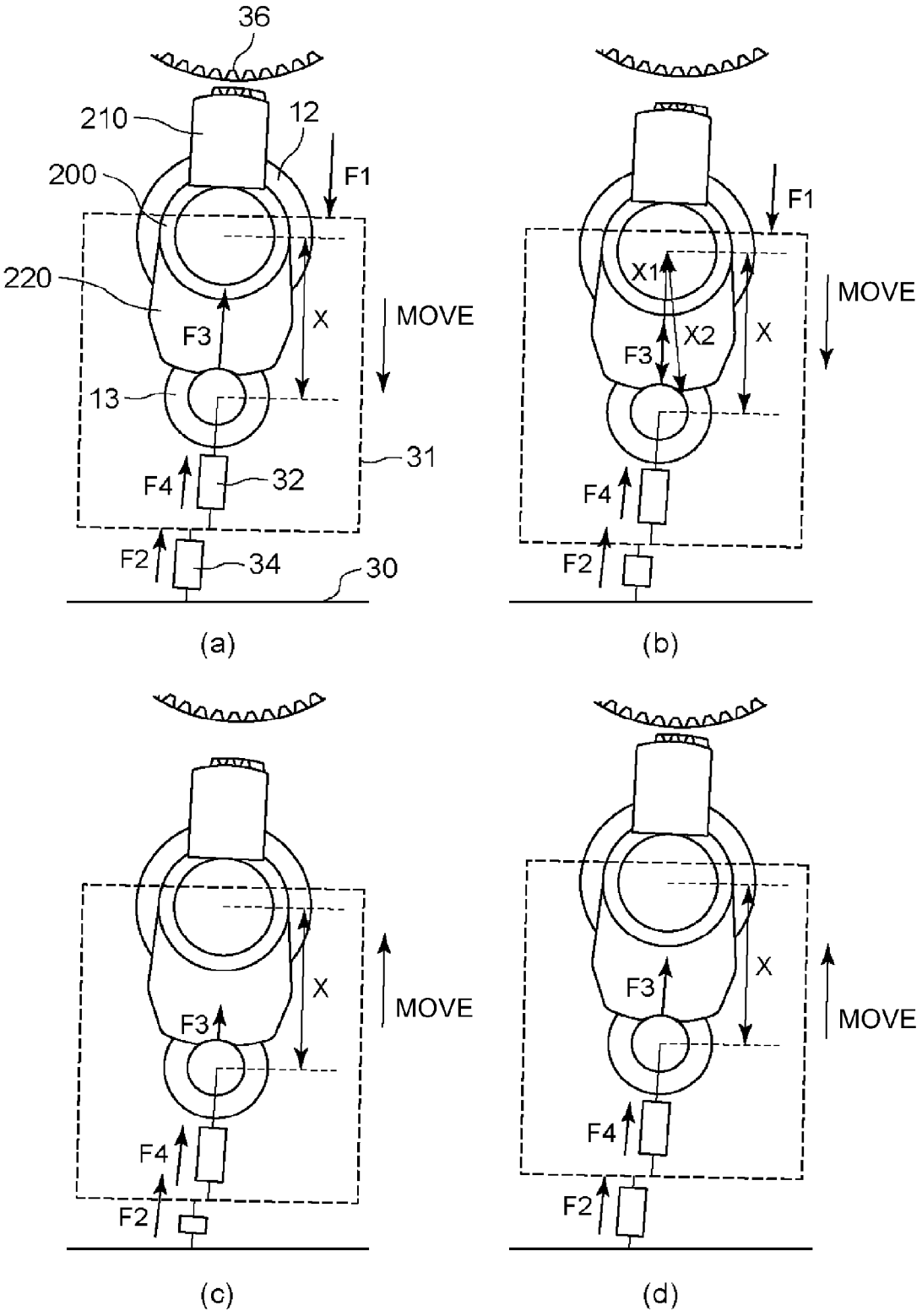
FIG. 9 is a schematic illustration of a state when the space keeping member moves away from the photosensitive member.

Part (a) of FIG. 9 schematically illustrates the charging roller 12, the cleaning roller, the space keeping member 200, the charging roller urging spring 32 and the cleaning roller urging spring 34 at the instance when the space keeping member 200 and the charging roller 12 move away from the photosensitive drums 11 by the vibration and/or falling of the drum cartridge, in this embodiment. By the impact received by the drum cartridge, a force F1 is supplied to the charging roller 12 and the charging roller bearing 31 in the direction of wave from the photosensitive drum 11. On the other hand, an urging force F2 is applied to the charging roller and the charging roller bearing 31 toward the photosensitive drum 11 by the charging roller urging spring 32. As shown in part (a) of FIG. 9, when the force F1 is larger than the urging force F2, the charging roller 12 and the charging roller bearing 31 start to move away from the photosensitive drum 11. At this time, the charging roller urging spring 32 starts to be compressed. And, to the cleaning roller 13 which is supported by the charging roller bearing 31 so as to be movable relative to the charging roller 12, an inertia is applied in the direction opposite to the direction of the movement of the charging roller 12 and the charging roller bearing 31, so that the space keeping member 200 receives the force F3 which is a sum of the inertia and the urging force F4 applied by the cleaning roller urging spring 34 through the cleaning roller 13. Therefore, the distance X between the cleaning roller 13 and the charging roller 12 remains and changed so that the space keeping member 200 continues to be supported by the cleaning roller 13.

Part (b) of FIG. 9 schematically illustrates the states of the charging roller 12, the cleaning roller, the space keeping member 200, the charging roller urging spring 32 and the cleaning roller urging spring 34 in the process of movement of the space keeping member 200 and the charging roller 12 away from the photosensitive drum 11 after the start of such movement. At this time, no inertia produced in the stand of the movement is applied to the cleaning roller 13, and the space keeping member 200 receives from the cleaning roller 13 the force F3 which is equal to the urging force F4 by the cleaning roller urging spring 34. Therefore, the cleaning roller 13 moves away from the photosensitive drum 11 together with the charging roller 12 and the charging roller bearing 31 while keeping the distance X from the charging roller 12.

Part (c) of FIG. 9 schematically illustrates the states of the charging roller 12, the cleaning roller the space keeping member 200, the charging roller urging spring 32 and the cleaning roller urging spring 34 at the time of the start of movement of the space keeping member 200 and the charging roller 12 toward the photosensitive drum by the urging force F2 of the compressed charging roller urging spring at the end of the movement of the space keeping member 200 and the charging roller 12 away from the photosensitive drum 11. At this instance, inertia is applied to the cleaning roller 13 in the direction away from the photosensitive drum 11. The inertia is in the direction opposite to the direction of the urging force of the cleaning roller urging spring, and the space keeping member 200 receives the force F3 which is the urging force F4 deduced by the inertia. As a result, the distance X of the cleaning roller 13 from the charging roller 12 is maintained. The inertia is relatively small as compared with the force F1, and therefore, it does not exceed the urging force F4 except for the case of very strong impact.

Part (d) of FIG. 9 schematically illustrates the states of the charging roller 12, the cleaning roller, the space keeping member 200, The charging roller urging spring 32 and the cleaning roller urging spring 34 in the process of the movement of the space keeping member 200 and the charging roller 12 toward the photosensitive drum 11 after the start of such movement. At this time, F1 or inertia are not be applied, and the space keeping member 200 receives the force F3 toward the rotation axis of space keeping member 200 as shown in the Figure from the cleaning roller 13, so that the distance X of the cleaning roller 13 from the charging roller 12 is maintained.

As described in the foregoing, the spacer member receives from the cleaning roller 13 the force F3 toward the rotation axis of the space keeping member 200, and in the state that the distance X is maintained between the cleaning roller 13 and the charging roller 12, the cleaning roller 13 abuts to and presses the receiving surface 221 as the first portion of the spacer member 200, as shown in part (b) of FIG. 9. In the both sides of the receiving surface 221, there are provided a second portion and a third portion which are longer than the first portion in the straight line distance from the rotation axis. In this embodiment, the straight line distance from the rotation axis to the first portion is X1, and the straight line distances from the rotation axis to the second portion and to the third portion are X2 which is longer than X1. When the second portion or the third portion passes the rotation shaft 13*a* of the cleaning roller 13 by the rotation of the spacer member, the cleaning roller urging spring 34 urging the cleaning roller 13 toward the rotation axis is compressed, so that the frictional force at the contact portion between the rotation shaft 13*a* and the spacer member is larger as compared with the state before the second portion or third portion passes the rotation shaft 13*a*. Therefore, in order for the second portion or the third portion to pass the rotation shaft 13*a*, a larger force is required to rotate the spacer member. Even if the space keeping member 200 and the charging roller 12 move away from the photosensitive drum 11 due to the vibration or falling of the drum cartridge of this embodiment, as shown in part (a) of FIG. 9 through part (d) FIG. 9, the spacer member is not capable of rotate writing of the second portion or the third portion because of the provisions of the second portion and the third portion, as long as the rotation shaft 13*a* of the cleaning roller 13 contacts to the spacer member by the urging force of the cleaning roller urging spring 34, and therefore, unintentional disestablishment of the spaced state can be suppressed.

(Automatic Disestablishment of Space Keeping)

Referring to FIG. 7, automatic release or disestablishment of the space keeping state will be described. FIG. 7 is an illustration of the automatic disestablishment operation of the space keeping.

When a new drum cartridge 100 is mounted to the main assembly of the image forming apparatus and the main assembly of the image forming apparatus is operated, a driving force (rotational force) is supplied from the photosensitive drum 11 from the motor provided in the main assembly of the image forming apparatus, in the initial operation of the main assembly of the image forming apparatus.

When the rotation of the photosensitive drum 11 starts with the space keeping state in which the photosensitive drum 11 and the charging roller 12 are spaced from each other and the charging roller 12 and the cleaning roller 13 are spaced from each other as shown in part (a) of FIG. 7, the gear 36 starts to rotate with the rotation of the photosensitive drum 11 as shown in part (b) of FIG. 7. By this, the engaging portion 211 of the space keeping member 200 as the spacer member which is in engagement with the gear 36 is rotated by the rotational force received from the gear 36, so that the space keeping member 200 is rotated, and the rotation shaft 13*a* of the cleaning roller 13 as the supporting member rides over the end portion functioning second portion in the upstream side of the receiving surface 221 with respect to the rotational direction of the space keeping member 200. Upstream of the receiving surface 221 with respect to the rotational direction of the space keeping member 200, the second portion is provided which is longer in the straight line distance from the rotation axis of the space keeping member 200 in the plane perpendicular to the rotational axis of the photosensitive member than the first portion which is pressed by the cleaning roller 13 in the space keeping state. As shown in part (a) of FIG. 7, the straight line distance X2 from the rotation axis to the second portion is longer than the straight line distance X1 from the rotation axis to the first portion.

In the state that the rotation shaft 13*a* of the cleaning roller has ridden over the upstream end portion of the receiving surface 221, the space keeping state is disestablished. In other words, the contact surface of the cleaning roller 13 relative to the rotation shaft 13*a* has such a configuration that in the rotation of the space keeping member 200 from the spacing position to the disestablished (released) position (contact position) by the driving force received from the gear 36, the straight line distance between the rotation axis of the space keeping member 200 and the cleaning roller 13 increases from X1 to X2 (FIG. 7) and then decreases.

Focused on the line X2 connecting the rotation axis of the space keeping member 200 and the second portion, the operation of the second portion of the space keeping member 200 rides over the rotation shaft 13*a* of the cleaning roller 13 as the supporting member corresponds to the line X2 passes the line X1 which connects the rotation axis of the space keeping member 200 and the first portion at which the distance therebetween is the minimum, by the space keeping member 200 rotates from the spacing position to the disestablished position.

Therefore, in order to rotate the space keeping member 200, the cleaning roller 13 has to be moved toward the upstream with respect to the urging direction in which the urging force of the cleaning roller urging spring 34 applies, that is, the cleaning roller urging spring 34 has to be compressed.

At this time, the gear 36 and the engaging portion 211 are engaged with each other, and therefore, it is possible to rotate the space keeping member 200 by the rotational force of the gear 36 to ride over the second portion provided at the end portion in the upstream of the receiving surface 221.

In this embodiment, the third portion is provided in the downstream side of the receiving surface 221 with respect to the rotational direction of the space keeping member 200, and the straight line distance of a downstream end portion as the third portion from the rotation axis of the space keeping member 200 in the plane perpendicular to the rotational axis of the photosensitive member is longer than the distance of the first portion which is pressed by the cleaning roller 13 in the space keeping state.

Therefore, in the space keeping state before the drum cartridge is mounted to the main assembly of the image forming apparatus, even if a large vibration is imparted to the drum cartridge during the transportation thereof, the cleaning roller 13 is kept pressing the space keeping member as described in conjunction with FIG. 9, and the rotation shaft 13*a* of the cleaning roller 13 is incapable of writing over any of the opposite end portions of the receiving surface 221 (second portion, third portion), and therefore, the space keeping member 200 is in capable of rotating, so that the space keeping state is maintained.

As shown in part (c) of FIG. 7, when the space keeping member 200 is further rotated by the rotation of the gear 36, the engagement between the gear 36 and the engaging portion 211 is disestablished. At this time, the cleaning roller 13 receives an urging force from the cleaning roller urging spring 34 in the direction indicated by an arrow A. The force in the direction A is converted to a force effective to rotate the space keeping member in the direction indicated by a arrow B by a spacing assistance surface 222 (contact portion) provided on the space keeping member 200. The direction of the converted force is codirectional with the rotation of the space keeping member 200 toward the spacing disestablishment position. The spacing assistance surface 222 disposed in a further upstream of the upstream side end portion (second portion) of the receiving surface 221 with respect to the rotational direction when receiving the driving force from the gear 36, and the straight line distances X3 and X4 from the rotation axis of the space keeping member 200 to the contact portion are shorter than the straight line distance X2 from the rotation axis to the second portion, and the straight line distance from the rotation axis to the contact portion decreases toward the downstream with respect to the rotational direction, as indicated by X3 and X4 in part (c) of FIG. 7. By such a creation of the contact portion, the force in the direction A can be converted to a rotating force in the direction B. In other words, when the engaging portion 211 is disengaged from the gear 36, the rotation shaft 13*a* of the cleaning roller 13 is contacted to the spacing assistance surface 222 (contact portion), and the spacing assistance surface 222 receive the urging force from the cleaning roller urging spring 34 through the rotation shaft 13*a* of the cleaning roller 13, so that the space keeping member 200 is rotated in the direction of the engaging portion 211 being away from the gear 36. As shown in part (d) of FIG. 7, the engaging portion 211 of the space keeping member 200 is disengaged from the gear 36, and the charging roller 12 is brought into contact to the surface of the photosensitive drum 11, and in addition, the cleaning roller 13 is brought into contact to the charging roller 12, thus disestablishing the spaced state. In this manner, the space keeping member 200 is rotatable between the spacing position and the release (spacing disestablished) position in which the spacing state between the photosensitive drum 11 and the charging roller 12 is disestablished to permit the contact between the photosensitive drum 11 and the charging roller. By the rotation of the space keeping member 200 from the spacing position to the release position, the spaced state can be disestablished.

Even when the receiving surface 221 is provided so as to provide a rotation resistance of the space keeping member 200 against the urging force of the cleaning roller urging spring 34, the drive connecting portion 211 is in engagement with the gear 36 on the other receiving surface 221 is ridden over, and therefore, the automatic releasing operation is not prevented.

By the provision of the spacing assistance surface 222, even after the rotation of the space keeping member 200 brings the engaging portion 211 out of engagement with the gear 36, the space keeping member 200 is rotated by the urging force of the cleaning roller urging spring 34 in the direction of the engaging portion 211 being away from the gear 36, thus disestablishing the space keeping state. After the space keeping state is disestablished, the space keeping member 200 is prevented from rotating in the direction opposed to the direction B by the cleaning roller 13 contacted to the charging roller 12, and therefore, the engaging portion 211 is not contacted to the gear 36, thus keeping the spaced state therebetween.

In addition, in this embodiment, the spacing is effected between the charging roller 12 and the cleaning roller 13 as well as the spacing between the charging roller 12 and the photosensitive drum 11, by which the deformations of the charging roller 12 and/or the cleaning roller 13 which may be caused by a long term non-operation-state in the state that the cleaning roller 13 is kept in contact with the charging roller 12 can be avoided.

As described in the foregoing, according to this embodiment, even if the vibration and/or shock is imparted to the drum cartridge with the result of movement of the space keeping member 200 away from the photosensitive drum 11, the likelihood of the unintentional disestablishment of the spaced state between the photosensitive drum 11 and the charging roller 12 is decreased.

(Embodiment 2)

Figure 10:
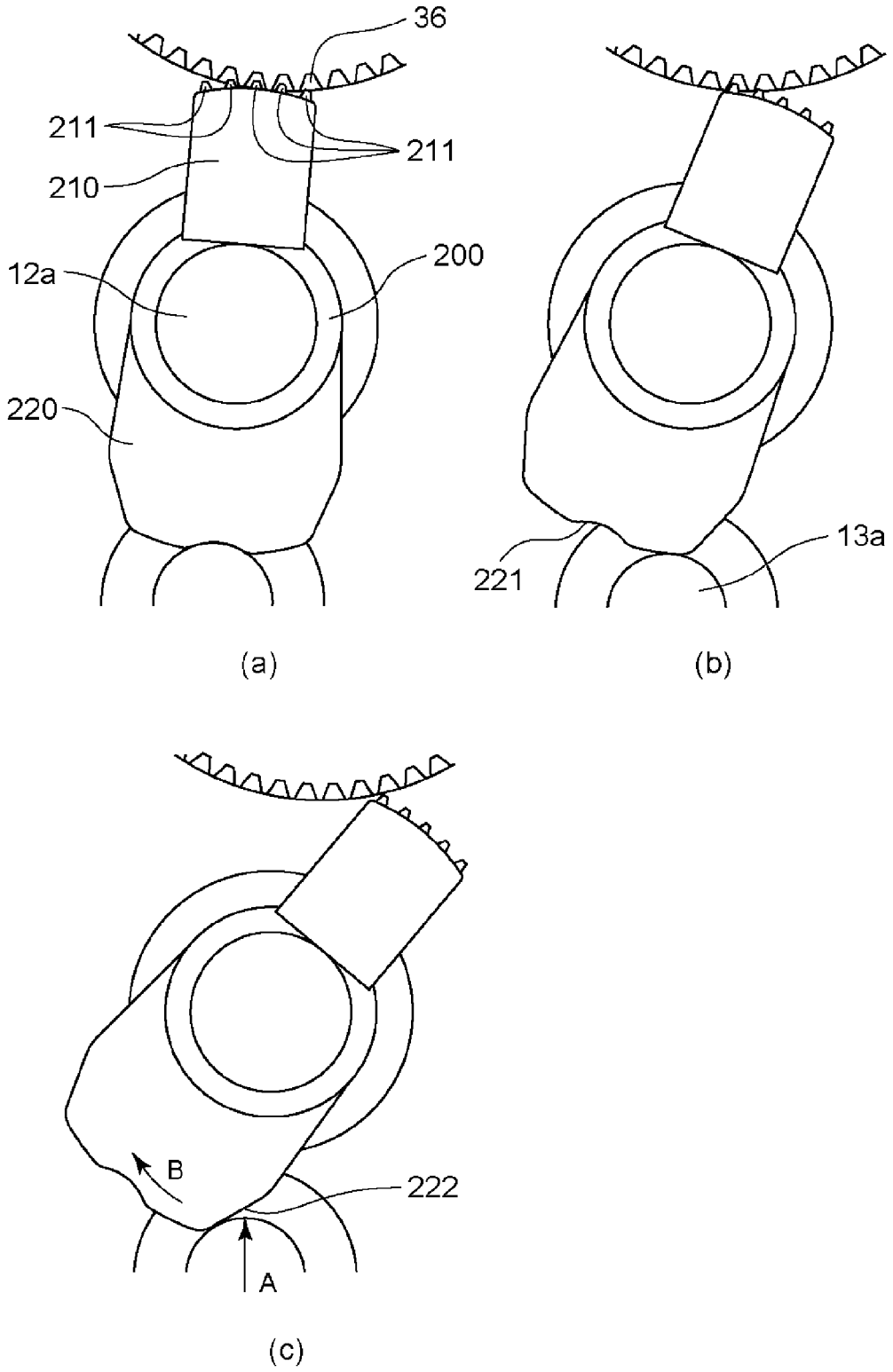
FIG. 10 is an illustration of an example of operation in which a configuration of an engaging portion of the space keeping member is different.

In Embodiment 1, the engaging portion 211 is in the form of gear teeth, but this is not inevitable to the present invention, and the engaging portion 211 may be any if it can engage with the gear 36 to receive the rotational force from the gear 36, and as shown in FIG. 10, it may comprise projections disposed in the same pitch as the gear teeth pitch of the 36 without deteriorating the advantageous effects of Embodiment 1.

(Engaging Portion in Embodiment 2)

Figure 11:
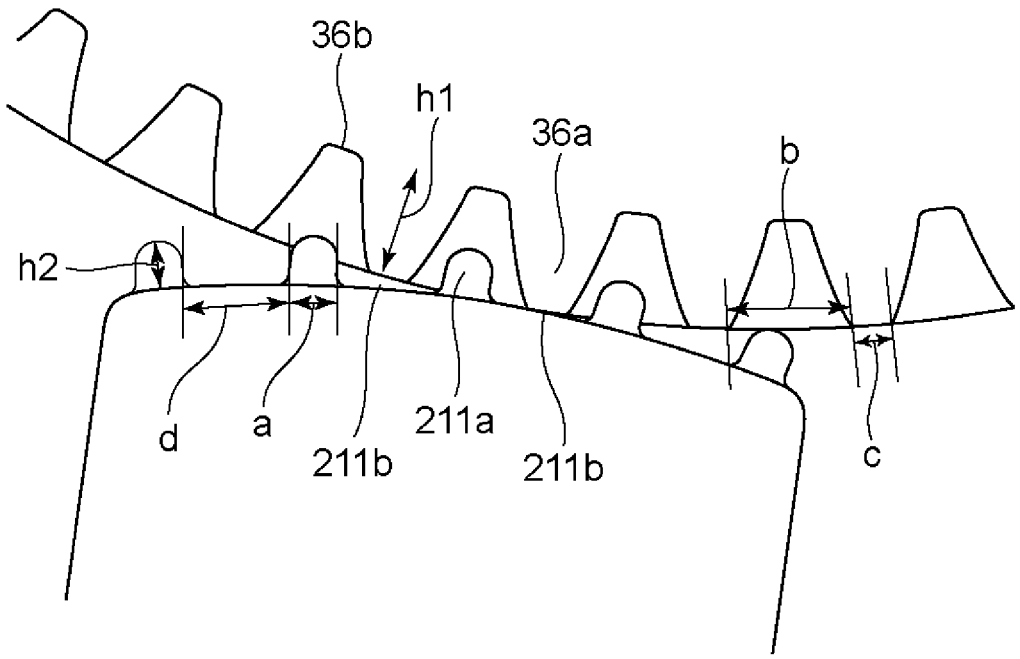
FIG. 11 is an illustration of an engaging portion between the photosensitive member gear and the engaging portion of the space keeping member.
Figure 12:
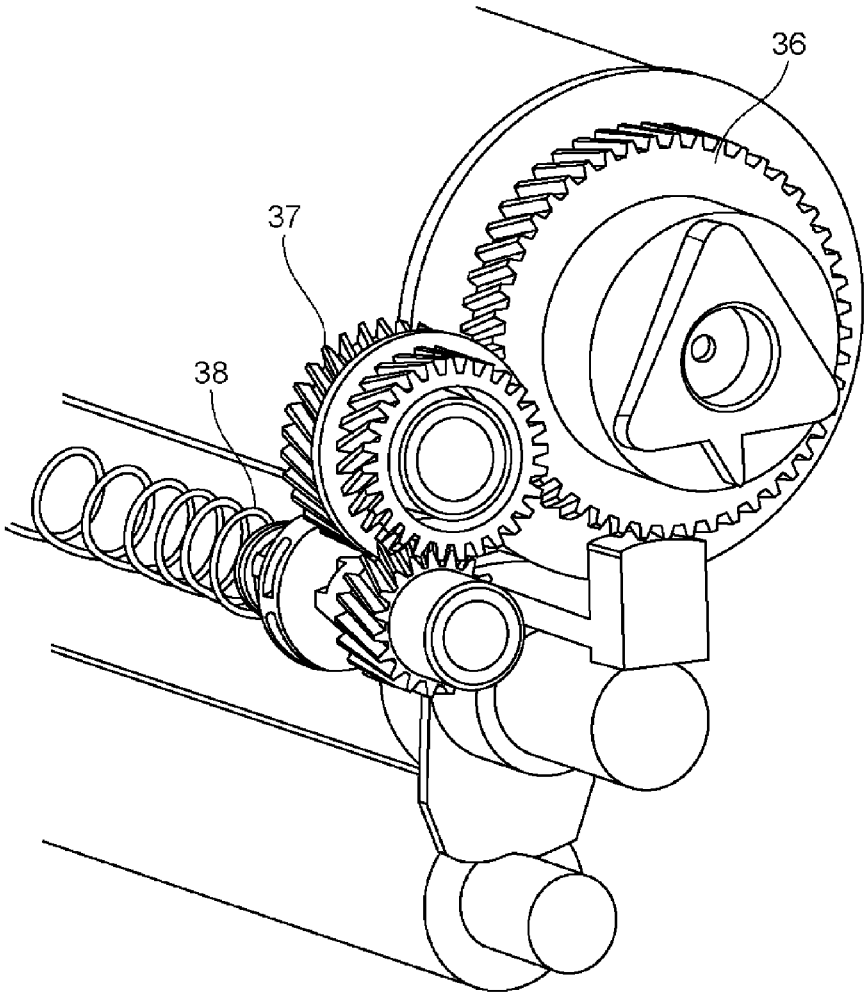
FIG. 12 is an illustration of the peripheral parts of the photosensitive member gear of the photosensitive member unit.

FIG. 11 illustrates the engaging portion between the engaging portion 211 of the space keeping member 200 and the photosensitive member gear 36. FIG. 12 is a perspective view of the photosensitive member gear 3 and the structure therearound in this embodiment.

As shown in FIG. 12, in this embodiment, the gear 37 is engaged with the photosensitive member gear 36, and the driving force of the photosensitive member gear 36 is transmitted through the gear 37 to drive the toner feeding screw.

As shown in FIG. 11, in this embodiment, the surface of the space keeping member 200 opposed to the photosensitive member gear 36 is provided with a plurality of projected portions 211*a* projecting toward the photosensitive member gear. The projected portion 211*a* is smaller as compared with the recess between adjacent gear teeth 36*a* of the photosensitive member gear 36.

FIG. 11 shows the state in which the projected portion 211*a* is in the middle of the adjacent gear teeth 36*a*, and the projected portion 211*a* is spaced from the side surfaces of the adjacent gear teeth at the opposite side with respect to the rotational direction of the space keeping member 200.

More particularly, FIG. 11 shows the state in which the both sides of the projected portion 211*a* with respect to the rotational direction of the space keeping member 200 are away from the side surfaces of the gear teeth 36*a*. However, in the state that one side of the projected portion 211*a* with respect to the rotational direction of the space keeping member 200 contact to the gear tooth 36*a*, the opposite side of the projected portion 211*a* is spaced from the gear tooth 36*a*. In addition, as shown in FIG. 11, a free end of the gear tooth 36*a* of the photosensitive member gear 36 contacts a bottom surface portion 211*b* between the adjacent projected portion 211*a*.

In this embodiment, the width a of the projected portion 211*a* is 0.4 mm in this embodiment. A distance b between the free ends of the adjacent gear teeth of the photosensitive member gear 36 is 1.04 mm. In this manner, the width a of the projected portion 211*a* is smaller than the distance b between the free ends of the gear teeth 36*a* at the opposite sides of the projected portion (the distance between adjacent gear teeth 36*a* of the photosensitive member gear 36).

A width c between free ends of the adjacent gear teeth 36*a* is 0.34 mm in this embodiment. The distance d between bottoms of the projected portion 211*a* is 0.9 mm in this embodiment. Thus, the width of the free end portion of the gear tooth 36*a* is smaller than the distance between the bottom portions of the projected portion 211*a* at the opposite sides of the gear tooth 36*a* in the rotational direction of the space keeping member 200.

A height h1 of the gear tooth 36*a* is 6.0 mm in this embodiment. A height h2 of the projected portion 211*a* is 0.4 mm in this embodiment. By this, the free end portion of the projected portion 211*a* does not contact the bottom of the gear teeth 36*a* of the photosensitive member gear 36. It is preferable that the height of the projected portion 211*a* is not more than 60% of the height of the gear teeth 36*a*.

When the spaced state is disestablished, the side surface of the gear tooth 36*a* of the photosensitive member gear 36 starting the rotation thereof as a result the reception of the driving force from the main assembly A contacts to the side surface of the projected portion 211*a*. And, by the gear tooth 36*a* urging the side surface of the projected portion 211*a*, the driving force is transmitted to the space keeping member 200 to rotate the space keeping member 200.

Figure 13:
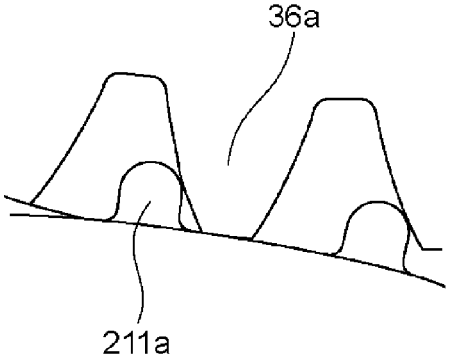
FIG. 13 is an illustration of an engaging portion between the photosensitive member gear and the engaging portion of the space keeping member.

At this time, as shown in FIG. 13, the projected portion 211*a* contacts such a gear tooth 36*a* as is in the upstream side gear tooth 36*a* of the gear teeth 36*a* positioned at the both sides of the projected portion 211*a* with respect to the rotational direction of the space keeping member 200 and does not contact such a gear tooth 36*a* as is in the downstream side gear tooth 36*a* of the gear teeth 36*a* positioned at the both sides of the projected portion 211*a*. In other words, at this time, the projected portion 211*a* contacts only one of the gear teeth 36*a* at the opposite sides of the projected portion 211*a* with respect to the rotational direction of the space keeping member 200.

FIG. 11 illustrates the state in which the projected portion 211*a* is in the middle of the recess between adjacent gear teeth 36*a* of the photosensitive member gear 36. However, as shown in FIG. 11, the projected portion 211*a* is capable of contacting one of the gear tooth 36*a* provided at the opposite sides of the gear teeth, but this in capable of contacting both of them. In other words, in the spaced state, each of the projected portions 211*a* is spaced from a side surface of at least one of the gear teeth gear tooth of the gear tooth 36*a* provided at the both sides of the projected portion 211*a* with respect to the rotational direction of the space keeping member 200.

When the projected portion 211*a* collides against the side surface of the gear tooth 36*a* of the photosensitive member gear 36, the projected portion 211*a* does not contact to the side surface of the gear tooth 36*a* provided opposed to the gear tooth 36*a* abutted by the projected portion 211*a*. Therefore, by rotation of the photosensitive member gear 36 in the direction of releasing the collision, the force caused by the collision can be released.

As a result, production of dimple or damage attributable to the collision of the projected portion 211*a* to the side surface of the gear tooth 36*a* can be reduced, and therefore, the likelihood of the image defect during the image forming operation after the mounting of the photosensitive member unit 100 to the main assembly of the image forming apparatus can be reduced.

In this embodiment, the free end portion of the projected portion 211*a* is arcuate without corner so that the projected portion 211*a* can easily slide on the surface of the gear tooth 36*a*. By this, when the projected portion 211*a* contacts to the gear tooth 36*a*, the force received by the gear tooth 36*a* from the projected portion 211*a* at the time of the rotation of the photosensitive member gear 36 can be easily released.

(Embodiment 3)

In Embodiments 1, 2, the projected portion 211*a* is provided on the space keeping member 200, but in Embodiment 3 which will be described in the following, the projected portion 211*a* is not provided.

Figure 14:
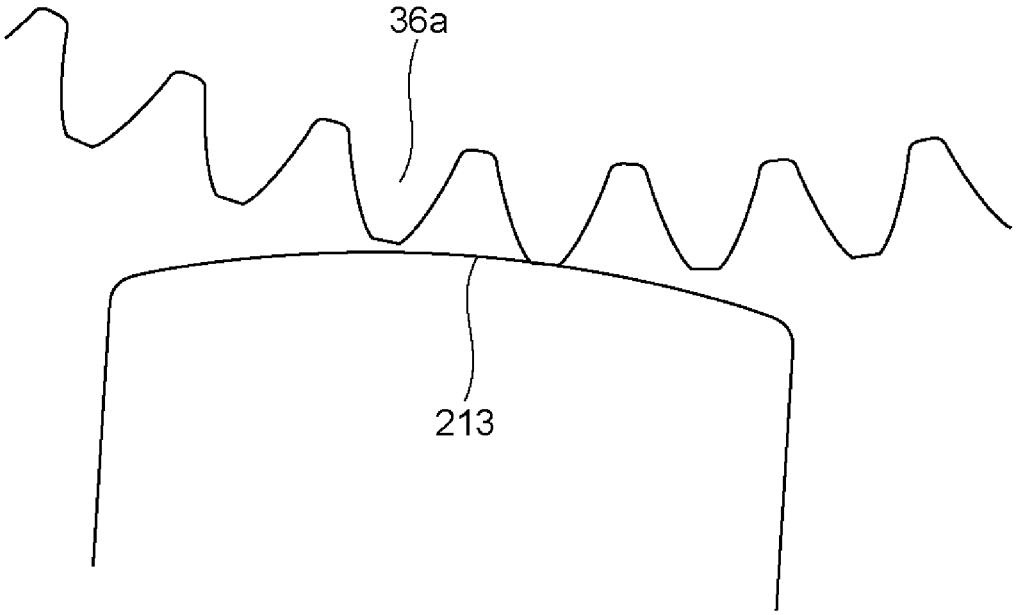
FIG. 14 is an illustration of a contact portion between the photosensitive member gear and the space keeping member.

FIG. 14 is an illustration of a contact portion between the space keeping member 200 and the photosensitive member gear 36 in this embodiment.

As shown in FIG. 14, the surface of the space keeping member 200 opposed to the photosensitive member gear 36 is provided with a surface 213 which is contacted by the free end of the gear tooth 36*a* of the photosensitive member gear 36 in the spaced state in which the photosensitive drum 11 and the charging roller 12 are spaced from each other. The contact surface 213 is a smooth surface made of material having a relatively high friction coefficient such as rubber or the like.

When the spaced state is to be disestablished, the space keeping member 200 is rotated by the frictional force between the free end of the gear tooth 36*a* of the photosensitive member gear 36 and the contact surface 213 upon the start of the rotation of the photosensitive member gear 36, so that the spaced state can be disestablished.

In this embodiment, no projection is provided toward the photosensitive member gear 36, on the space keeping member 200. Therefore, even if the vibration is imparted to the photosensitive member unit 100 with the result of temporary spacing of the space keeping member 200 from the photosensitive member gear 36, any part of the space keeping member 200 is contacted to the side surface of the gear tooth of the photosensitive member gear 36. As a result, the production of the dimple or the damage on the side surface of the gear tooth 36*a* can be suppressed.

Figure 15:
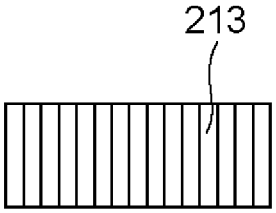
FIG. 15 is a top plan view of the contact portion between the photosensitive member gear and the space keeping member.

In this embodiment, the contact surface 213 is made of rubber, but this is not inevitable to the present invention, and it will suffice if the space keeping member has a friction coefficient enough to permit the rotation of the space keeping member by the frictional force relative to the free end of the gear tooth. In addition, in order to increase the frictional force, the surface of the contact surface 213 may be roughened, or shallow grooves may be provided as shown in FIG. 15. In the case that the surface is roughened or the grooves are provided, it is preferable that the height of the grooves or pits are small enough to prevent the contact to the side surface of the gear tooth.

(Embodiment 4)

In Embodiment 1-Embodiment 3, by the proper determination of the configuration of the space keeping member 200 at the position opposed to the photosensitive member gear 36, the likelihood of the image defect in the image forming operation after the mounting of the photosensitive member unit 100 to the main assembly of the image forming apparatus is suppressed.

In this embodiment, the position of engagement between the space keeping member 200 and the photosensitive member gear 36 is properly determined.

Figure 16:
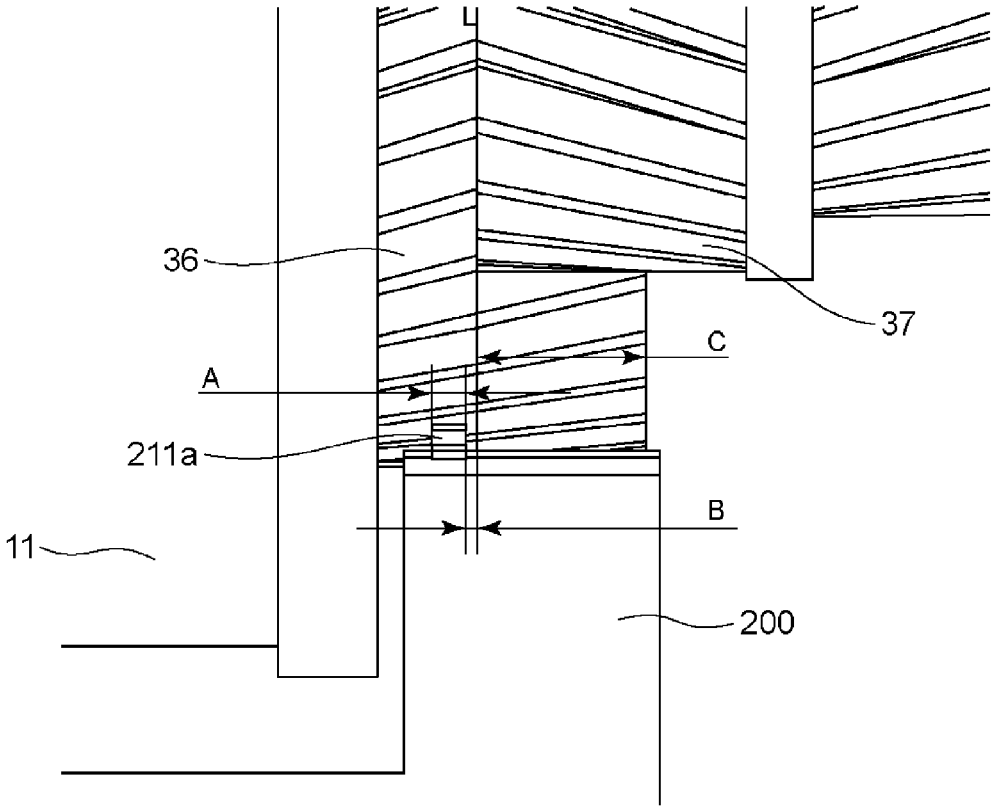
FIG. 16 is an illustration of an engagement region between the photosensitive member gear and the engaging portion of the space keeping member in a rotational axis direction.

FIG. 16 is a side view of the engaging portion between the photosensitive member gear 36 and the space keeping member 200 in this embodiment. In this embodiment, projected portions 211*a* are provided on the surface of the space keeping member 200 opposed to the photosensitive member gear 36, and the projected portions 211*a* are engaged with the photosensitive member gear 36.

As shown in FIG. 16, a gear 37 as a second gear for transmitting the driving force from the photosensitive member gear 36 to the toner feeding screw is engaged with the photosensitive member gear 36 in a region C which is a part of the width of the photosensitive member gear 36 with respect to the axial direction of the photosensitive member gear 36.

The projected portion 211*a* of the space keeping member 200 is engaged with the photosensitive member gear 36 in the region A of the width of the photosensitive member gear 36 with respect to the axial direction of the photosensitive member gear 36, the region A being not overlapped with the region C. In this embodiment, a region B is provided between the region A and the region C in consideration of wobbles between the gears in the axial direction during the driving operation.

With such a structure, even if the damage or dimple is produced on the side surface of the gear tooth 36*a* in the region A by the vibration imparted to the photosensitive member, the damage or dimple attributable to the collision between the photosensitive member gear 36 and the projected portion 211*a* can be avoided or minimized in the region C in which the gear 37 is engaged. The configuration of the projected portion 211*a* in this embodiment may have such a gear tooth configuration that the both side surfaces contact to the side surfaces of the gear teeth 36*a* in the spaced state, or the gear configuration in the foregoing embodiments.

(Other Embodiments)

Figure 17:
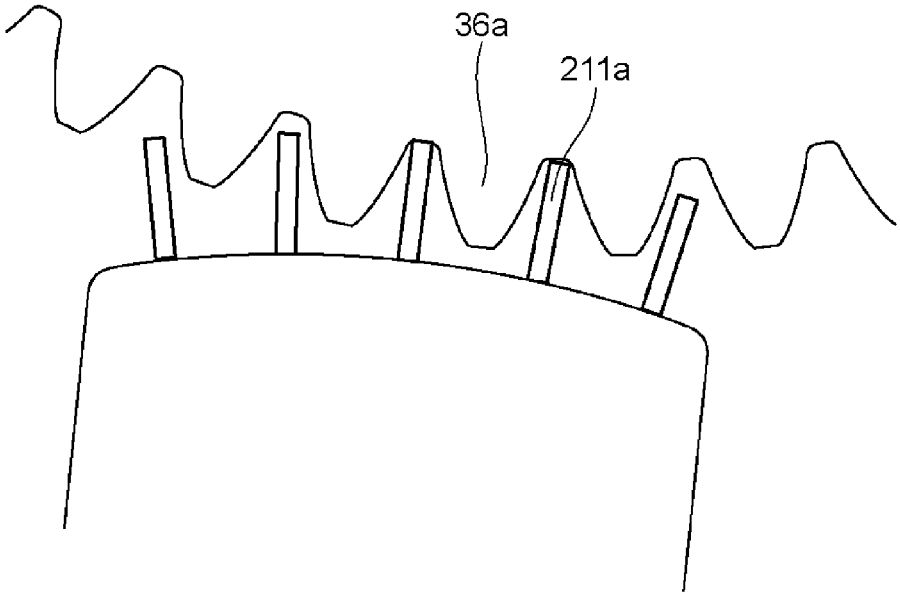
FIG. 17 is an illustration of an engaging portion between the photosensitive member gear and the engaging portion of the space keeping member.

In this embodiment, in the spaced state between the charging roller 12 and the photosensitive drum 11, the free end of the gear tooth 36*a* of the photosensitive member gear 36 contacts to the bottom surface portion 211*b* between the adjacent projected portions 211*a*. However, the present invention is not limited to such a example, but as shown in FIG. 17, the free end of the projected portion 211*a* may contact to the tooth bottom portion 36*b* between the adjacent gear tooth 36*a*. In such a case, the free end of the gear tooth 36*a* does not contact to the bottom surface portion 211*b*. And, similarly to the embodiments, in the spaced state, each of the projected portions 211*a* is spaced from a side surface of at least one of the gear teeth 36*a* of the gear teeth 36*a* disposed at the opposite sides of the projected portion 211*a* with respect to the rotational direction of the space keeping member 200. The advantageous effects of the foregoing embodiments can be provided in this embodiment.

In this Embodiment 1, in the spaced state between the charging roller 12 and the photosensitive drum 11, the free end of the gear tooth 36*a* of the photosensitive member gear 36 contacts to the bottom surface portion 211*b* between the adjacent projected portions 211*a*. However, the present invention is not limited to such a example, but as shown in FIG. 15, the free end of the projected portion 211*a* may contact to the tooth bottom portion 36*b* between the adjacent gear teeth 36*a*. In such a case, the free end of the gear tooth 36*a* does not contact to the bottom surface portion 211*b*.

Also in this embodiment, similarly to Embodiment 1, in the spaced state, each of the projected portions 211*a* is spaced from a side surface of at least one of gear teeth 36*a* of the gear teeth 36*a* disposed at the both sides of the projected portion 211*a* with respect to the rotational direction of the space keeping member 200. The same advantageous effects of Embodiment 1 can be provided in this embodiment.

In the foregoing embodiments, the space keeping member 200 is supported by the rotation shaft 12*a* of the charging roller 12 rotatably about the rotational axis 12*a*, but is not inevitable that the rotation axis of the space keeping member 200 is coaxial with the rotational axis of the charging roller. For example, the rotational shaft of the space keeping member 200 is supported by the bearings 31 for the charging roller 12 so that the rotation axis of the space keeping member 200 crosses a line connecting the rotational axis of the photosensitive drum 11 and the rotational axis of the charging roller 12.

In this embodiment, the space keeping member 200 is provided with the second portion and the third portion, the provision of the third portion is not inevitable in the case that the spaced keeping member 200 is rotatable only in one direction toward the release position from the spacing position or in the case that the rotation of the space keeping member 200 from the spacing position toward the release position is prevented by abutment of a part of the space keeping member 200 to another member such as the drum cleaning device 15 or the like.

In addition, in this embodiment, the receiving surface 211 has an arcuate configuration, but the present invention is not limited to these consideration, and it will suffice if the both sides of the receiving surface 221 with respect to the rotational direction of the space keeping member 200 are provided with portions (second portion, third portion) at which the straight line distance from the rotation axis of the space keeping member 200 in the plane perpendicular to the rotational axis of the photosensitive member is longer than that of the portion (first portion) supported by the cleaning roller 13 in the space keeping state. For example, as shown in part (a) of FIG. 18, a V-shaped receiving surface 211 contacting the cleaning roller at two positions is usable. In addition, as shown in part (b) of FIG. 18, a rectangular recess configuration is usable, and as shown in part (c) of FIG. 18, a flat surface is usable, and in these cases, the same advantageous effects as in Embodiment 1 are provided.

Figure 18:
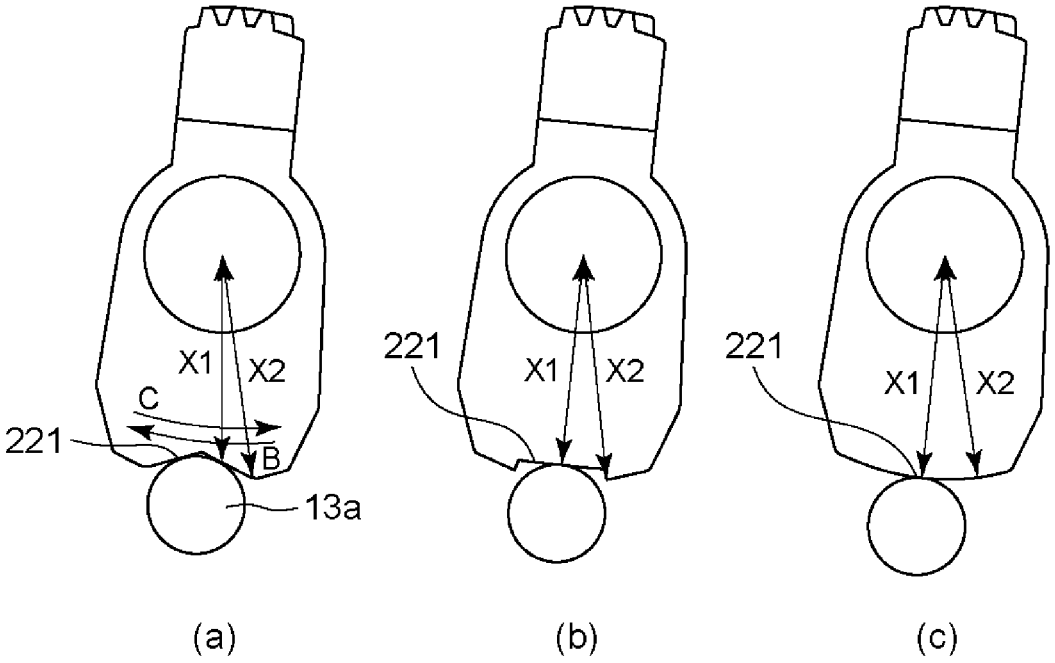
FIG. 18 illustrates another example of a receiving surface configuration of the space keeping member.

In the case that the cleaning roller 13 contacts the receiving surface 211 at two positions as shown in part (a) of FIG. 18, the first portion is the portion indicated by the straight line distance X1 from the rotation axis depending on the rotational direction. When, for example, the space keeping member 200 is rotatable in the direction B only, the position of the first portion is the upstream side contact portion with respect to the rotational direction of the space keeping member 200 of the two positions contacting to the cleaning roller 13 in the spaced state, as shown in part (a) of FIG. 18. In such a case, as shown in part (a) of FIG. 18, the second portion is in the upstream side of the first portion with respect to the rotational direction. When the space keeping member 200 is rotatable also in the direction C, the first portion for the rotation in the direction C is in the downstream side contact position of the two positions contacting to the cleaning roller 13 in the spaced position with respect to the rotational direction, as contrasted to the position corresponding to X1 in part (a) of FIG. 18. The third portion is provided in the upstream of the first portion with respect to the rotational direction C at a position where the straight line distance from the rotation axis is longer than the straight line distance to the first portion from the rotation axis.

Figure 19:
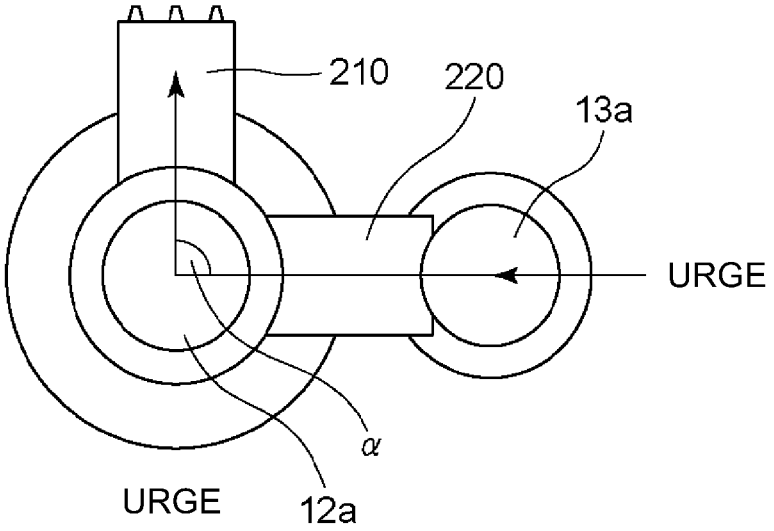
FIG. 19 illustrates another example of the configuration of the space keeping member.

In the foregoing embodiments, the urging direction of the charging roller urging spring 32 for the charging roller 12 is the same as the urging direction of the cleaning roller urging spring 34 for the cleaning roller 13, but this is not inevitable to the present invention. For example, as shown in FIG. 19, and the urging direction of the cleaning roller urging spring 34 may be perpendicular to the urging direction of the charging roller urging spring 32 in the plane perpendicular to the rotation axis of the space keeping member. With this structure, when the movement of the charging roller 12 toward the photosensitive drum 11 by the urging force of the charging roller urging spring 32 starts as shown in part (c) of FIG. 9 after the end of the movement of the charging roller 12 away from the photosensitive drum 11 upon the vibration and/or impact to the drum cartridge, the distance between the cleaning roller 13 and the charging roller 12 expands by the inertia F5 in the direction away from the photosensitive drum 11, by which the cleaning roller 13 is prevented from spacing from the spaced keeping member 200. The angle $\alpha$ formed between the urging direction of the charging roller urging spring 32 and the urging direction of the cleaning roller urging spring 34 is preferably 90° as shown in FIG. 19, but it is not limited to this angle, and the angle may be satisfactory if it is not less than 90♂○♂ and less than 180♂○♂.

In the addition, in this embodiment, the cleaning roller 13 is used as a supporting member for supporting the space keeping member, but the present invention is not limited to this example, and in the case of not using the cleaning roller, a member for pressing and supporting the space keeping member by the urging force provided by a spring similar to the cleaning roller urging spring 34 may be used in place of the cleaning roller 13. In such a case, because no cleaning roller 13 is employed, it is unnecessary to take into consideration the proper nip pressure between the cleaning roller 13 and the charging roller 12, and therefore, the urging force by the cleaning roller urging spring 34 can be made larger than in the Embodiment 1, so that the separation of the supporting member from the space keeping member 200 can be further suppressed.

In the foregoing embodiments, the space keeping member 200 is provided at each of the opposite longitudinal end portions of the charging roller, but this is not limiting to the present invention, and the space keeping member 200 may be provided only at one of the longitudinal end portions of the charging roller 12. In this case, in the end portion not provided with the space keeping member 200, a dimension of the clearance by the space keeping member 200 may be set so that the rubber portion 12 of the charging roller 12 is out of contact to the photosensitive drum 12 and the cleaning roller 13, or the rubber portion 12 of the charging roller 12 contacts to the photosensitive drum 12 and the cleaning roller 13 in a non-image forming region. In such a case, one space keeping member is enough, so that the cost increase of the drum cartridge can be suppressed, in addition to the advantageous effects of Embodiment 1.

In the foregoing embodiments, the cleaning roller 13 is employed as the charging cleaning member, but this is not limiting to the present invention, and the use can be made with a blade for scraping the foreign matter off the surface of the charging roller 12 or a resin film or cleaning pad contacting with the surface of the charging roller 12, in which a portion for supporting the space keeping member 200 is provided.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Applications Nos. 2015-010359 filed on Jan. 22, 2015 and 2015-010360 filed on Jan. 22, 2015, which are hereby incorporated by reference herein in their entirety.

What is claimed is:

1. A photosensitive member unit detachably mountable to a main assembly of a image forming apparatus, said photosensitive member unit comprising:

a rotatable photosensitive member;

a charging member including an elastic layer and contactable to said photosensitive member to electrically charge said photosensitive member;

first urging means configured to urge said charging member toward said photosensitive member;

a rotatable portion provided on said photosensitive member and configured to rotate by a driving force from the main assembly;

a rotatable spacer member including a contact portion contacted to said rotatable portion and capable of receiving the driving force through said rotatable portion, said spacer member being rotatable between a spacing position for maintaining a spaced state in which said contact portion contacts said rotatable portion to space said charging member from said photosensitive member, and a contact position in which the spaced state between said photosensitive member and said charging member is disestablished to permit contact between said photosensitive member and said charging member, and said spacer member being movable toward said photosensitive member with movement of said charging member toward said photosensitive member by said first urging means when the spaced state is disestablished;

a supporting member configured to urge and support said spacer member in a state that said spacer member is in the spacing position; and second urging means configured to urge said supporting member toward a rotation axis of said spacer member.

2. A photosensitive member unit according to claim 1, wherein said spacer member has such a configuration that during rotation of said spacer member from the spacing position toward the contact position by the driving force received from said rotatable portion, a straight line distance between the rotation axis and said supporting member urged against said spacer member by said second urging means increases.

3. A photosensitive member unit according to claim 1, wherein said spacer member includes a contact portion to which said supporting member contacts when said contact portion is disengaged from said rotatable portion, and said spacer member is rotated in a direction of said contact portion being away from said rotatable portion by said contact portion of said supporting member being urged by said supporting member.

4. A photosensitive member unit according to claim 1, wherein an urging direction of said second urging means is different from an urging direction of said first urging means.

5. A photosensitive member unit according to claim 1, wherein said spacer member has such a configuration that during rotation of said spacer member from the spacing position in a direction opposite a direction in which said spacer member is rotated by the driving force received through said rotatable portion, the straight line distance between the rotation axis and said supporting member urged by said second urging means increases.

6. A photosensitive member unit according to claim 5, wherein said spacer member is rotatable so that when said spacer member is in the spacing position, said cleaning member and said charging member are spaced from each other, and when said spacer member is in the contact position, said cleaning member and said charging member are contact each other.

7. A photosensitive member unit according to claim 1, wherein said supporting member includes a charging cleaning member configured to contact said charging member by an urging force of said second urging means to clean a surface of said charging member.

8. A photosensitive member unit according to claim 7, wherein said charging cleaning member is a rotatable cleaning roller including an elastic layer.

9. A photosensitive member unit according to claim 1, wherein said rotatable portion includes a gear fixed to said photosensitive member so as to be integrally rotatable with said photosensitive member about a rotational axis of said photosensitive member.

10. A photosensitive member unit according to claim 9, further comprising:

a cleaning member configured to contact a surface of said photosensitive member to clean the surface;

a collection portion configured to collect toner removed by said cleaning member; and a feeding portion configured to feed the toner collected in said collection portion to an outside of said photosensitive member unit, wherein said feeding portion is capable of receiving the driving force through said gear to feed the toner collected by said collection portion to the outside of said photosensitive member unit.

11. A photosensitive member unit according to claim 1, further comprising a holding member configured to rotatably holding said charging member, said holding member permitting said supporting member to move toward said charging member.

12. A photosensitive member unit according to claim 1, wherein said spacer member is supported by a rotation shaft of said charging member so as to be rotatable about said rotation shaft.

13. A photosensitive member unit according to claim 1, wherein said contact portion is provided with a projection engaged with said rotatable portion.

14. A photosensitive member unit according to claim 1, wherein said contact portion has a flat surface contacting to a projection of rotatable portion.

15. An image forming apparatus for forming an image on a recording material comprising a photosensitive member unit according to claim 1.

16. A photosensitive member unit according to claim 1, wherein said spacer member is provided with a recess contacting said supporting member.

17. A photosensitive member unit according to claim 1, wherein said supporting member is a cleaning roller contacted to said charging member to clean said charging member, and wherein a shaft of the cleaning roller is fitted in a recess.

18. A photosensitive member unit according to claim 1, wherein said second urging member urges said supporting member in a direction toward said contact portion.

19. A photosensitive member unit according to claim 18, wherein said spacer member has a surface recessed toward said contact portion, and said supporting member contacts said recessed surface.

20. A photosensitive member unit according to claim 1, wherein when said spacer member is in the spacing position, said supporting member is opposed to said contact portion with said charging member interposed therebetween.

21. A photosensitive member unit according to claim 20, wherein said spacer member is provided with a recess contacting said supporting member, the recess being recessed toward said contact portion.

22. A photosensitive member unit detachably mountable to a main assembly of an image forming apparatus, said photosensitive member unit comprising:

a rotatable photosensitive member;

a charging member including an elastic layer and contactable to said photosensitive member to electrically charge said photosensitive member;

urging means configured to urge said charging member toward said photosensitive member;

a first gear provided on said photosensitive member configured to rotate by a driving force from the main assembly, said first gear including a plurality of gear teeth and a tooth bottom portion between adjacent ones of said gear teeth;

a second gear engaged with said first gear to be rotatable by a driving force from said first gear;

a spacer member including an engaging portion engaged with said first gear and capable of receiving the driving force from said first gear, said spacer member being rotatable between a spacing position for maintaining a spaced state in which said engaging portion is engaged with said first gear to space said charging member from said photosensitive member, and a contacting position in which the spaced state between said photosensitive member and said charging member is disestablished to permit contact between said photosensitive member and said charging member, said spacer member urging said first gear by said urging means when said spacer member is in the spacing position, and being movable toward said photosensitive member with movement of said charging member toward said photosensitive member by said urging means when the spaced state is disestablished;

a plurality of projected portions provided on said engaging portion and projected toward said first gear; and a bottom surface portion provided on said engaging portion between adjacent ones of said projected portions, wherein a height of said gear teeth is larger than that of said projected portions, and a free end portion of a gear tooth of said gear teeth is contacted to said bottom surface portion.

23. A photosensitive member unit according to claim 22, wherein a width of said projected portions measured in the rotating direction of said spacer member is smaller than a width of said gear teeth measured in a rotational direction of said second gear.

24. A photosensitive member unit according to claim 22, wherein in the spaced state, said free end portion of said gear tooth contacts said bottom surface portion with a free end portion of said projected portion not contacting a tooth bottom portion.

25. A photosensitive member unit according to claim 22, further comprising:

a cleaning member configured to contact a surface of said photosensitive member to clean said surface;

a collection portion configured to collect toner removed by said cleaning member; and a feeding portion configured to feed the toner collected in said collection portion to an outside of said photosensitive member unit, wherein said feeding portion is capable of receiving the driving force through said second gear to feed the toner collected in said collection portion to the outside of said photosensitive member unit.

26. An image forming apparatus for forming an image on a recording material comprising a photosensitive member unit according to claim 22.

27. A photosensitive member unit detachably mountable to a main assembly of an image forming apparatus, said photosensitive member unit comprising:

a rotatable photosensitive member;

a charging member including an elastic layer and contactable to said photosensitive member to electrically charge said photosensitive member;

urging means configured to urge said charging member toward said photosensitive member;

a first gear provided on said photosensitive member configured to rotate by a driving force from the main assembly;

a second gear engaged with said first gear and rotatable by a rotational force of said first gear; and a spacer member including a contact portion contacting said first gear and capable of receiving the driving force through said first gear, said spacer member being rotatable between the spacing position for maintaining a spaced state in which said contact portion is engaged with said first gear to space said charging member from said photosensitive member, and a contacting position in which the spaced state between said photosensitive member and said charging member is disestablished to permit contact between said photosensitive member and said charging member, said spacer member urging said first gear by said urging means when said spacer member in the spacing position, and being movable toward said photosensitive member with movement of said charging member toward said photosensitive member by said urging means when the spaced state is disestablished, wherein said contact portion is engaged with said first gear in a region not overlapping with a region in which said contact portion is engaged with said second gear, with respect to a rotational axis direction of said first gear.

28. A photosensitive member unit according to claim 27, wherein said photosensitive member is rotatable by the driving force, and said first gear is rotatable by the rotation of said photosensitive member.

29. A photosensitive member unit according to claim 27, further comprising:

a cleaning member configured to contact a surface of said photosensitive member to clean the surface;

a collection portion configured to collect toner removed by said cleaning member; and a feeding portion configured to feed the toner collected in said collection portion to an outside of said photosensitive member unit, wherein said feeding portion is capable of receiving the driving force through said second gear to feed the toner collected in said collection portion to the outside of said photosensitive member unit.

30. A photosensitive member unit detachably mountable to a main assembly of an image forming apparatus, said photosensitive member unit comprising:

a rotatable photosensitive member;

a charging member including an elastic layer and contactable to said photosensitive member to electrically charge said photosensitive member;

urging means configured to urge said charging member toward said photosensitive member;

a first gear provided on said photosensitive member configured to rotate by a driving force from the main assembly, said first gear including a plurality of gear teeth and a tooth bottom portion between adjacent ones of said gear teeth;

a second gear engaged with said first gear to be rotatable by a driving force from said first gear;

a spacer member including an engaging portion engaged with said first gear and capable of receiving the driving force from said first gear, said spacer member being rotatable between a spacing position for maintaining a spaced state in which said engaging portion is engaged with said first gear to space said charging member from said photosensitive member, and a contacting position in which the spaced state between said photosensitive member and said charging member is disestablished to permit contact between said photosensitive member and said charging member, said spacer member urging said first gear by said urging means when said spacer member is in the spacing position, and being movable toward said photosensitive member with movement of said charging member toward said photosensitive member by said urging means when the spaced state is disestablished;

a plurality of projected portions provided on said engaging portion and projected toward said first gear; and a bottom surface portion provided on said engaging portion between adjacent ones of said projected portions, wherein a height of said projected portions is larger than that of said gear teeth, and a free end portion of a projected portion of said projected portions is contacted to said tooth bottom portion.

31. A photosensitive member unit according to claim 30, wherein a width of said projected portions measured in the rotating direction of said spacer member is smaller than a width of said gear teeth measured in a rotational direction of said second gear.

32. A photosensitive member unit according to claim 30, wherein, in the spaced state, said free end portion of said projected portion contacts said tooth bottom portion with a free end portion of said gear tooth not contacting said bottom surface portion.

33. A photosensitive member unit according to claim 30, further comprising:

a cleaning member configured to contact a surface of said photosensitive member to clean the surface;

a collection portion configured to collect toner removed by said cleaning member; and a feeding portion configured to feed the toner collected in said collection portion to an outside of said photosensitive member unit, wherein said feeding portion is capable of receiving the driving force through said second gear to feed the toner collected in said collection portion to the outside of said photosensitive member unit.

34. An image forming apparatus for forming an image on a recording material comprising a photosensitive member unit according to claim 30.

* * * * *